US012317955B2

(12) United States Patent
Drake et al.

(10) Patent No.: US 12,317,955 B2
(45) Date of Patent: Jun. 3, 2025

(54) PERSONALIZED FOOTWEAR WITH INTEGRATED CAGING SYSTEM

(71) Applicant: Drake Labs, Inc., Seattle, WA (US)

(72) Inventors: Stephan Drake, Salt Lake City, UT (US); Robert John Horacek, Park City, UT (US); Raymond Alfred Horacek, Yokohama (JP)

(73) Assignee: Drake Labs, Inc., Seattle, WA (US)

( * ) Notice: Subject to any disclaimer, the term of this patent is extended or adjusted under 35 U.S.C. 154(b) by 26 days.

(21) Appl. No.: 17/670,367

(22) Filed: Feb. 11, 2022

(65) Prior Publication Data

US 2022/0248807 A1 Aug. 11, 2022

Related U.S. Application Data

(60) Provisional application No. 63/148,559, filed on Feb. 11, 2021.

(51) Int. Cl.
*A43B 23/02* (2006.01)
*A43C 11/16* (2006.01)

(52) U.S. Cl.
CPC ..... *A43B 23/02* (2013.01); *A43B 23/0225* (2013.01); *A43B 23/0295* (2013.01); *A43C 11/165* (2013.01)

(58) Field of Classification Search
CPC ..... A43B 23/0295; A43B 23/0225; A43B 23/0275; A43B 23/0245; A43B 23/02;
(Continued)

(56) References Cited

U.S. PATENT DOCUMENTS 5,896,683 A * 4/1999 Foxen ..... A43B 23/08 36/89
2006/0048413 A1* 3/2006 Sokolowski ..... A43B 23/0215 36/45

(Continued)

FOREIGN PATENT DOCUMENTS

| | | | |
|---|---|---|---|
| GB | 2544733 | A | 5/2017 |
| IT | TV20110013 | A1 | 8/2012 |
| WO | 2020232555 | A1 | 11/2020 |

OTHER PUBLICATIONS

International Searching Authority, International Search Report and Written Opinion, PCT Patent Application PCT/US2022/016234, mailed Sep. 9, 2022, 14 pages.

*Primary Examiner* — Patrick J. Lynch
*Assistant Examiner* — Brianna T. Duckworth
(74) *Attorney, Agent, or Firm* — Perkins Coie LLP

(57) ABSTRACT

A customizable footwear assembly and manufacturing method. The footwear assembly having a plantar shell and dorsal shell forming a caging system. The plantar shell has a contour shaped to conform with a bottom surface contour of the wearer's foot. An upper perimeter portion forms an opening to the interior area configured to receive at least a portion of the wearer's foot therethrough. A dorsal shell has a shaped to conform with an upper surface contour of the wearer's foot. The dorsal shell is movable between open and closed positions relative to the interior area of the plantar shell. The dorsal shell has an outer perimeter portion configured to engage the upper perimeter portion of the plantar shell to form a caging system that transfer loads between the dorsal and plantar shells when the dorsal shell is in the closed position and during use of the footwear by the wearer.

19 Claims, 27 Drawing Sheets

(58) Field of Classification Search
CPC ..... A43B 11/00; A43B 5/14; A43B 3/0027; A43B 3/06; A43B 3/16; A43C 11/165
See application file for complete search history.

(56) References Cited

U.S. PATENT DOCUMENTS

| | | | | |
|---|---|---|---|---|
| 2008/0104778 | A1 | 5/2008 | Drake et al. | |
| 2009/0217552 | A1* | 9/2009 | Paintin | A43B 11/00 36/138 |
| 2012/0198730 | A1* | 8/2012 | Burch | A43B 23/0245 264/138 |
| 2012/0240428 | A1* | 9/2012 | Knoll | A43B 5/0427 36/50.1 |
| 2013/0298426 | A1* | 11/2013 | Pierce | A43C 11/1493 36/106 |
| 2017/0231319 | A1* | 8/2017 | Bohnsack | A43B 13/04 36/92 |
| 2018/0220734 | A1* | 8/2018 | Dyer | A43C 11/20 |
| 2019/0223555 | A1* | 7/2019 | Iannuzzi | A43B 1/0027 |
| 2019/0365021 | A1* | 12/2019 | Okajima | A43B 1/14 |
| 2020/0229677 | A1* | 7/2020 | Gonzales | A47L 23/00 |

* cited by examiner

PERSONALIZED FOOTWEAR WITH INTEGRATED CAGING SYSTEM

CROSS REFERENCE TO RELATED APPLICATIONS

This non-provisional patent application claims priority to and the benefit of U.S. Provisional Patent Application No. 63/148,559, titled Personalized Footwear with Integrated Caging System, filed Feb. 11, 2021, which is incorporated herein in its entirety by reference thereto.

TECHNICAL FIELD

Embodiments of the present invention are directed to footwear, and more particularly to personalized performance footwear systems with enhanced support and fit for the wearer's feet.

BACKGROUND

Footwear that properly fits a wearer's feet, particularly for high-performance activities, is extremely important. People's feet, ankles, and lower legs, however, are all different with different sizes, shapes, alignment, and/or relative motion during subtle and dynamic activities. Conventional footwear is typically constructed with a small range of sizes (lengths and widths), so each size can generally fit a wide variety of feet. As a result, conventional footwear provides a rough fit for a person's foot but does not provide a personalized fit for a person's specific foot shape and arrangement. In performance activities, such as cycling, skiing, snowboarding, skating, etc., the associated footwear must allow for efficient force and load transfer between the wearer's foot, ankle, and lower leg to the associated equipment (i.e., pedals, skis, boards, blades, wheels, etc.). If the footwear is inefficient or does not adequately facilitate the force and load transfer, performance of the activity can substantively suffer.

Conventional performance footwear often tries to maintain efficient force and load transfer by providing laces, straps, buckles, or other closure systems for a tight fit. The uppers can also be made of stiff material with reduced flex to improve load transfer through the footwear. Unfortunately, this conventional tight performance fit typically sacrifices comfort for the wearer's feet. This conventional tight performance fit also does not adequately address pronation, supination, collapsed arch, or other foot alignment of the wearer's foot within the shoe or boot. Accordingly, custom footbeds, orthotics, or other additional support structures are often used within the shoe or boot to provide additional foot support, thereby adding to the complexity and cost of the footwear. These internal foot support structures attempt to control foot position or movement relative to a neutral stance from under the foot, which can cause issues with the wearer's nerves in the foot and leg and other negative restrictions to foot alignment or movement.

The human foot is a complex structure that can undergo a wide range of movements during high-performance activities. Too much movement of the foot structure within the footwear during dynamic movement, including monopedal and bipedal stances or movements, can have a negative impact on the force and load transfer to or from the footwear. Some conventional footwear systems have used a forefoot/midfoot compression system to apply a downward force on the foot's top portion above the instep. This downward compression seeks to minimize foot movement and restrict the maximum height of the foot's instep within the footwear at all times independent of the movement or position of the foot during an activity. Examples of such systems are disclosed in U.S. Pat. Nos. 4,534,122, 5,265,350, 5,459,949, and 5,634,284, and U.S. Patent Application Publication No. 2016/0242494, all of which are incorporated herein by reference thereto. The systems, however, are complex and can be expensive to integrate into performance footwear. Accordingly, there is a need for improved footwear that achieves precise and personalized fit, control, and comfort for a specific wearer's foot shape, size, and alignment, while maintaining comfort and ease of use.

DETAILED DESCRIPTION

Figure 1:
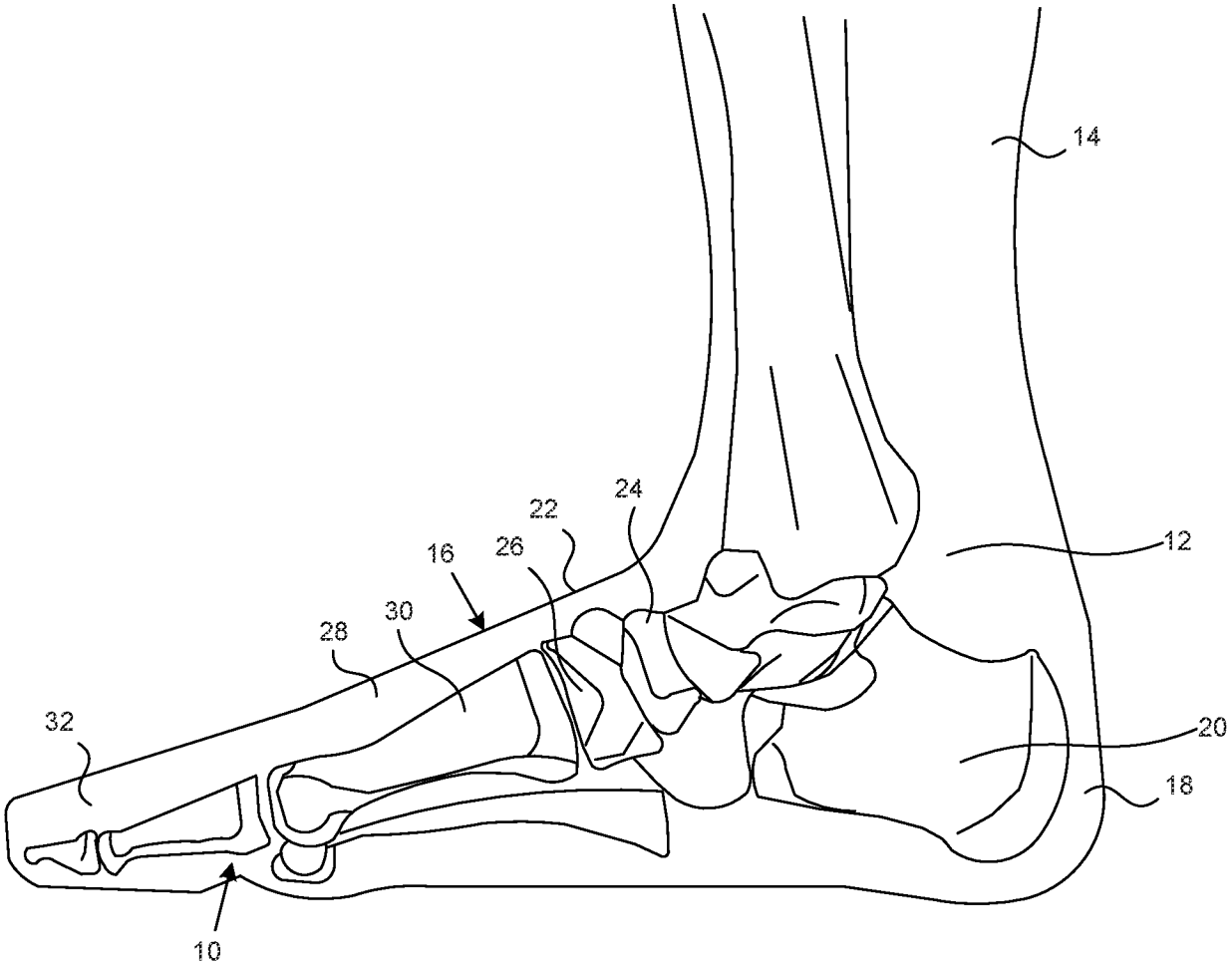
FIG. 1 is a schematic view of a foot, ankle, and lower leg of a human wearer.

The present technology provides footwear assemblies configured with a precise, personalized, performance fit for each wearer, along with associated manufacturing processes that overcome problems and drawbacks experienced by the prior art and that provide other benefits. A footwear assembly in accordance with embodiments of the present technology provide a personalized plantar shell defining an interior area shaped and sized to receive and contain a wearer's foot. The plantar shell is custom fit to the specific shape, size, and arrangement of the individual wearer's foot, such as from a 3-D foot scan, so as to precisely fit the wearer's foot. The plantar shell has an opening in the top area configured to allow the user to insert or remove the foot from the interior area and to expose the dorsal area of the wearer's foot forward of the ankle and above the instep area.

The plantar shell around the opening securely connects to a personalized, customized dorsal shell that extends over the foot's instep and covers the opening of the plantar shell. The configuration and engagement between the plantar and dorsal shells create a precision-fit caging system that securely contains and controls the wearer's foot, particularly during dynamic activities and motions. The dorsal shell, when in the closed position over the plantar shell, firmly engages the top instep portion of the foot, such that the dorsal shell compresses and pre-loads the wearer's instep within the caging system. In some embodiments, a seal is provided between the plantar and dorsal shells, so as to provide a water-tight seal between the plantar and dorsal shells.

The footwear assembly has one or more closure devices coupled to the plantar and dorsal shells to releasably hold the dorsal shell closed and to apply pressure to the instep of the wearer's foot. The closure device can be released to allow the dorsal shell to be moved to the open position for removal of the wearer's foot.

The footwear of the present technology is constructed specifically for the wearer's foot by 3-D printing (or other additive manufacturing techniques) of the plantar and dorsal shells based on a 3-D scan or other 3-D model of the wearer's foot. Other embodiments can utilize other manufacturing techniques, including non-additive manufacturing, while still providing the personalized construction and fit for the particular wearer's foot. In some embodiments, the plantar and dorsal shells are formed together, for example, as a single shell or shell assembly, and then separated after formation. In other embodiments, the plantar and dorsal shells are formed separately, for example, as two discrete components. In these and other embodiments, the footwear assembly can be a shoe, boot, sandal, mule, or other footwear style.

Embodiments of the present technology provide a method of manufacturing a footwear assembly. The method can comprise constructing a plantar shell of the footwear assembly based at least partially on plantar surface information associated with a plantar surface of a wearer's foot, wherein the plantar shell at least partially defines an interior area of the footwear assembly sized to receive the wearer's foot. The plantar shell has an upper perimeter portion forming an opening to the interior area configured to receive at least a portion of the wearer's foot therethrough. The method can also comprise constructing a dorsal shell of the footwear assembly based at least partially on dorsal surface information associated with a dorsal surface of the wearer's foot, wherein the dorsal shell is movable between (i) an open position in which the dorsal shell is movable relative to the plantar shell to allow the wearer's foot to be inserted or removed from the interior area, and (ii) a closed position in which the dorsal shell is coupled to the plantar shell to at least partially enclose the wearer's foot in the interior area. The dorsal shell can have an outer perimeter portion configured to engage the upper perimeter portion of the plantar shell to transfer loads between the dorsal and plantar shells when the dorsal shell is in the closed position and during use of the footwear by the wearer. The dorsal shell can be configured so a vertical position of the dorsal shell relative to the plantar shell is adjustable substantially without deformation of the dorsal shell and to provide adjustable compressive force to an instep portion of the wearer's foot when the dorsal shell is in the closed position.

Embodiments of the present technology provide a footwear assembly, comprising a plantar shell that at least partially defines an interior area of the footwear assembly. The interior area is sized to receive a wearer's foot. The plantar shell has a plantar shell contour shaped to conform with a bottom surface contour of the wearer's foot. The plantar shell has an upper perimeter portion forming an opening to the interior area configured to receive at least a portion of the wearer's foot therethrough. A dorsal shell has a dorsal shell contour shaped to conform with an upper surface contour of the wearer's foot. The dorsal shell is movable between (i) an open position in which the dorsal shell is positioned relative to the plantar shell to allow the wearer's foot to be inserted or removed from the interior area, and (ii) a closed position in which the dorsal shell is coupled to the plantar shell to at least partially enclose the wearer's foot in the interior area. The dorsal shell has an outer perimeter portion configured to engage the upper perimeter portion of the plantar shell to form a caging system that transfer loads between the dorsal and plantar shells when the dorsal shell is in the closed position and during use of the footwear by the wearer. The plantar shell can include a first locking feature, and the dorsal shell can include a second locking feature configured to detachably engage with the first locking feature. When the dorsal shell is in the closed position, the first locking feature engages the second locking feature to couple the plantar shell to the dorsal shell.

In some embodiments, the plantar shell can include one or more plantar shell ribs, and the dorsal shell can include one or more dorsal shell ribs. When the dorsal shell is in the closed position, the plantar shell ribs align with corresponding ones of the dorsal shell ribs to facilitate force transfer between the plantar shell and the dorsal shell. The plantar shell can be formed by a plurality of reinforcement ribs positioned and oriented at selected areas to control the force distribution and load paths in the plantar shell during use, wherein the plantar shell has openings free of material between the reinforcement ribs. The footwear assembly can include an inner liner within the interior area of the plantar shell, wherein the liner is configured to removably receive the wearer's foot. A closure device can be operably coupled to the plantar shell and the dorsal shell, wherein the closure device is movable between (i) an unlocked position in which the dorsal shell is movable between the open and closed positions, and (ii) a locked position in which the closure device secures the dorsal shell to the plantar shell in the closed position. The plantar shell or the dorsal shell can have an alignment feature configured to engage the other of the dorsal shell or the plantar shell and to control relative movement between the plantar shell and the dorsal shell when the dorsal shell is in the closed position.

One or more embodiment of the present technology provides a caging system for a footwear assembly to facilitate a wearer's performance in highly dynamic activities. The caging system comprises a plantar shell that at least partially defines an interior area of the footwear assembly sized to receive a wearer's foot, wherein the plantar shell includes an upper perimeter portion forming an opening to the interior area configured to receive at least a portion of the wearer's foot therethrough. The plantar shell can have (i) a forefoot shell portion shaped to conform to a corresponding forefoot portion of the wearer's foot, and (ii) a heel shell portion opposite the forefoot shell portion and shaped to conform to a corresponding heel portion of the wearer's foot. A dorsal shell is shaped to conform to an instep portion of the wearer's foot and releasably couplable to the plantar shell. The dorsal shell is movable between (i) an open position in which the dorsal shell is movable relative to the plantar shell to allow the wearer's foot to be inserted or removed from the interior area, and (ii) a closed position in which the dorsal shell is coupled to the plantar shell and applies a compressive force to the instep portion of the wearer's foot to reduce flexural motion of the wearer's foot. The dorsal shell has an outer perimeter portion configured to engage the upper perimeter portion of the plantar shell to form a caging system that transfer loads between the dorsal and plantar shells when the dorsal shell is in the closed position and during use of the footwear by the wearer. Other embodiments can include other features in combination with some or all of the above features.

Several specific details of the personalized footwear technology and associated fitting and manufacturing processes of the present technology are set forth in the following description and the Figures to provide a thorough understanding of certain embodiments of the invention. One skilled in the art, however, will understand that the present invention may have additional embodiments, and that other embodiments of the invention may be practiced without several of the specific features described below.

For purposes of discussion and reference, FIG. 1 is a schematic view of a person's foot 10, ankle 12, and lower leg 14. The foot 10 has a heel portion 18 including the calcaneus bone 20, an instep portion 22 including the navicular and cuneiform bones 24 and 26, and a forefoot portion 28 including the metatarsals bones 30. The top 16 of the foot 10 extends from the ankle 12, over the instep portion 22, to the toes 32.

Figure 2C:
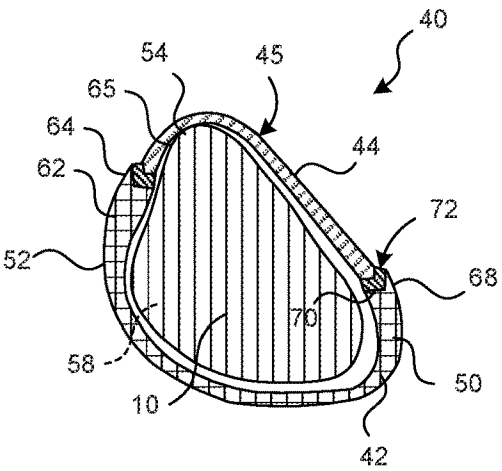
FIG. 2C is a cross-sectional view taken substantially along line 2C-2C of FIG. 2B.
Figure 2B:
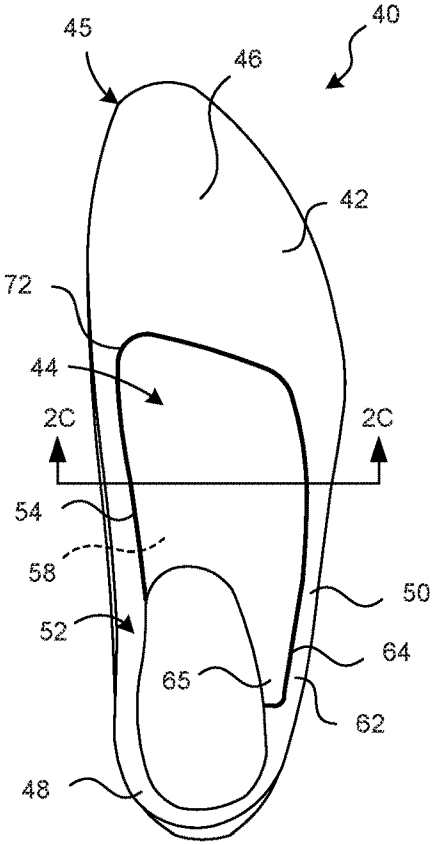
FIG. 2B is a plan view of the footwear assembly of FIG. 2A.
Figure 2A:
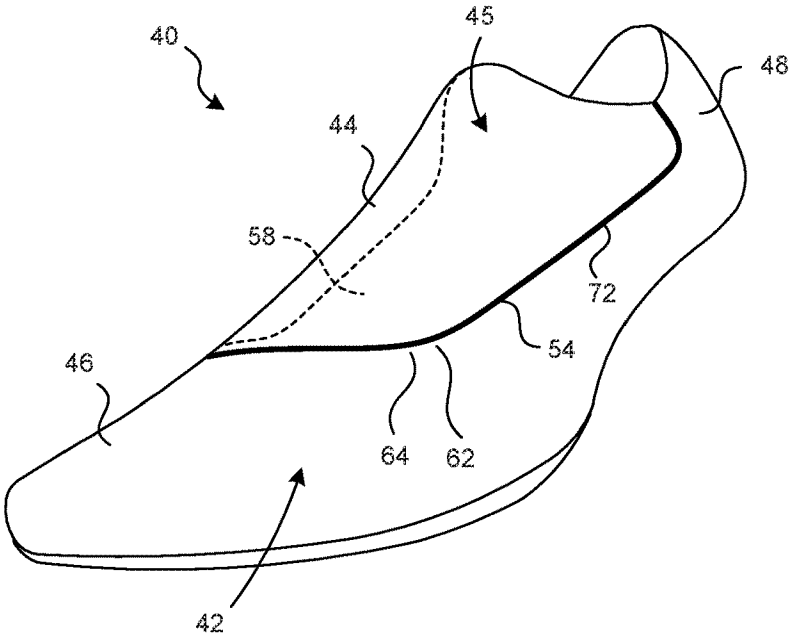
FIG. 2A is an isometric view of a footwear assembly in accordance with an embodiment of the present technology.

FIGS. 2A and 2B are isometric and top plan views of a footwear assembly 40 in accordance with an embodiment of the present technology. FIG. 2C is a cross-sectional view of the footwear assembly 40 taken substantially along line 2C-2C of FIG. 2B. As discussed in greater detail below, the footwear assembly 40 comprises personalized plantar and dorsal shells 42 and 44, respectively, precisely fit for a particular wearer's foot 10 (FIG. 1) to provide a caging system 45. The caging system 45 engages, captures, and retains the foot 10 in a comfortable and secure manner to facilitate performance in highly dynamic performance sports activities, such as cycling, skiing, snowboarding, skating, climbing, hiking, riding, and other activities. It is noted that the foot 10 for which the footwear assembly 40 is built may be a bare foot, a socked foot, a liner-covered foot, or other covered foot configuration. The footwear assembly 40 is configured to minimize movement of the foot 10 (FIG. 1) within caging system 45 to facilitate extremely efficient and precise load transfer between the wearer's foot 10 and the external environment, such as pedals, skis, a snowboard, a skate blade, wheels, the ground, or other external environment or components. The personalized construction of the footwear for the particular wearer's foot also allows for constructing an extremely comfortable fit around the wearer's foot substantially without sacrificing performance of the footwear assembly 40.

The footwear assembly 40 illustrated in FIGS. 2A-2C is a cycling shoe that has a contoured plantar shell 42 with a forefoot portion 46 that receives and is conformed to the forefoot portion of the wearer's foot. The plantar shell 42 also has a contoured heel portion 48 configured to receive and securely retain the foot's heel portion 18 (FIG. 1). Lateral and medial sidewalls 50 and 52 of the plantar shell 42 extend between the shoe's forefoot and heel portions 46 and 48. The plantar shell 42 has an upper opening 54 through which the wearer can insert or remove his or her foot from the plantar shell's interior area 58. The opening 54 is sized so that, when the wearer's foot is in the plantar shell 42, the top of the foot at the instep portion 22 (FIG. 1) is positioned within the opening 54.

The dorsal shell 44 is attached to the plantar shell 42 and is movable between an open position away from the opening 54 and a closed position covering the opening 54. When the dorsal shell 44 is in the open position, the wearer can insert or remove his or her foot from the plantar shell 42 through the opening 54. When the dorsal shell 44 is in the closed position, the dorsal shell 44 is positioned over and covers the foot's arch portion 22 (FIG. 1). The plantar and dorsal shells 42 and 44 are sized so that, when the dorsal shell 44 is in the closed position, the foot is firmly yet comfortably captured in the caging system 45. Also, the dorsal shell 44 firmly presses against the top of the wearer's foot along the instep portion 22 (FIG. 1) and applies a compressive downward force on the instep portion 22. Accordingly, the dorsal shell 44 in the closed position pre-compresses the foot's instep portion 22 (FIG. 1) with the caging system 45.

The precise and personalized fit of the plantar and dorsal shells 42 and 44 for the specific shape, size, and contour of individual wearer's foot 10 (FIG. 1) allows for an extremely comfortable fit that minimizes pressure points and limits undesired excessive foot movement within the caging system 45. Further, the contour and arrangement of the dorsal shell 44 is based on the actual foot shape, so that the dorsal shell 44 can be constructed to provide specific compressive loads against selected portions of wearer's instep portion 22 (FIG. 1). These directed compressive loads can provide for correction or modification of a foot's alignment, such as pronation, supination, or other alignment or movement of the foot. For example, the dorsal shell 44 can be constructed to provide a greater compressive load on the upper medial side or on the upper lateral side of the foot's instep area, depending upon the specific anatomy of the wearer's foot, ankle, and lower leg.

In conventional footwear, the top of a shoe or boot covers the instep portion but does not pre-compress the instep portion. During performance activities, the foot undergoes dynamic motion and can be subject to significant forces so as to compress the instep and flex the foot's skeletal structure. This motion of the foot within the conventional shoe can significantly reduce the efficiency of load and force transfer between the foot, the footwear, and the external equipment or environment. The footwear assembly 40 of the present technology provides the personalized caging system 45 via the plantar and dorsal shells 42 and 44, so the foot is closely contained in the interior area and is firmly restrained from excessive linear motion (longitudinal and lateral/medial motion) and rotational motion relative to the plantar and dorsal shells 42 and 44. The dorsal shell's pre-compression of the foot's instep portion 22 reduces the flexural motion of the instep portion within the caging system 45, thereby providing an extremely efficient force and load transfer to and from the wearer's foot 10, ankle 12, and/or lower leg 14 (FIG. 1) during an activity, such as a high-performance activity.

Referring again to FIGS. 2A-2C, the opening 54 in the plantar shell 42 is defined by a perimeter engagement portion 62 that extends above the lateral and medial sidewalls 50 and 52 and extends across the forefoot portion 46. The engagement portion 62 has an integrated locking feature 64 that mateably engages with a locking feature 65 on the perimeter edge portion 66 of the dorsal shell 44 when the dorsal shell 44 is in the closed position.

As best seen in FIG. 2C, the engagement portion 62 of the plantar shell has a stepped lock configuration with a shoulder member 68 extending upwardly from a generally horizontal support surface 70. Accordingly, the locking feature 64 has a generally L-shaped cross-section. The locking feature 65 on the dorsal shell's edge portion 66 has a mating shape that securely fits into and engages the plantar shell's locking feature 64, so as to releasably retain the dorsal shell in substantially planar alignment with the engagement portion 62 of the plantar shell 42. In the illustrated embodiment, the locking feature 65 of the dorsal shell 44 has generally orthogonal engaging surfaces (e.g., horizontal and vertical surfaces) that fit into and securely press against the support surface 70 and the shoulder member 68 when the dorsal shell 42 is in the closed position.

Although the locking features 64 and 65 of the illustrated embodiment have the shapes as discussed above, other embodiments can have locking features with different mating and/or locking arrangements configured to establish and maintain the interconnection and/or the substantially planar alignment of the planar and dorsal shells 42 and 44 at this dorsal/plantar joint when the dorsal shell is in the closed position. This substantially planar alignment between the plantar and dorsal shells 42 and 44 is configured to efficiently transmit loads or forces between the plantar and dorsal shells 42 and 44 and to or from the wearer's foot.

Figure 2D:
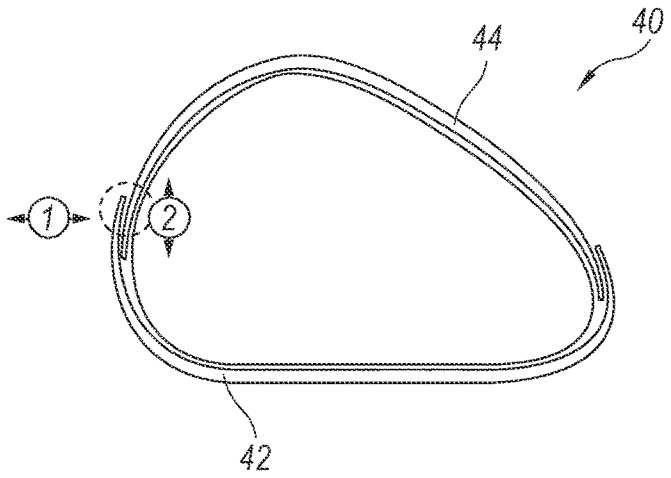
FIGS. 2D-2F are a top plan view and cross-sectional views of other embodiments of the footwear assembly
Figure 2E:
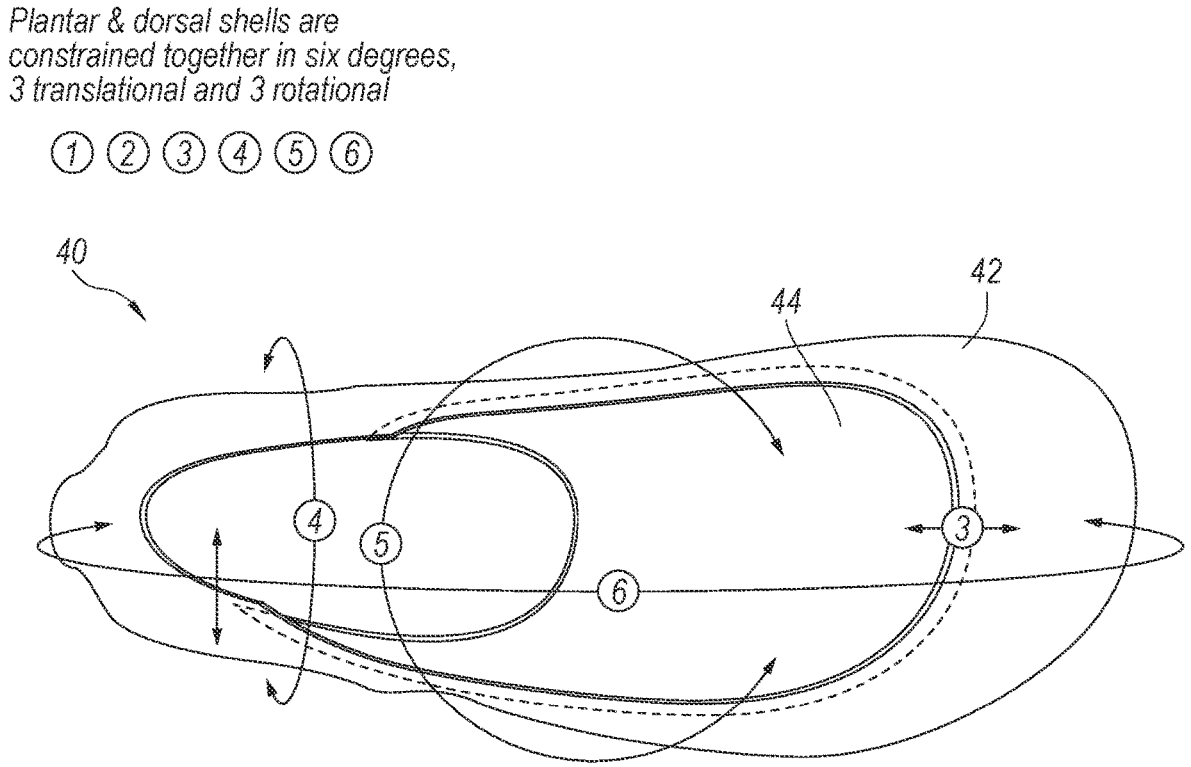

For example, another embodiment illustrated in FIGS. 2D and 2E could have vertical walls on the medial and lateral edges of the plantar shell 42, which the dorsal shell 44 fits into. These vertical walls prevent any motion of the dorsal shell 44 in the medial-lateral direction relative to the plantar shell 42. There is additionally a closure or restraint mechanism that holds the dorsal shell 44 in the downward closed position, applying the load on the users foot, and constraining the plantar and dorsal shells 42 and 44 together in the vertical direction. There can additionally be constraint between the plantar and dorsal shells 42 and 44 in the fore-aft direction. Therefore, the plantar and dorsal shells 42 and 44 are constrained together in the six degrees of freedom (three translational, three rotational) to effectively act as a monocoque shell and transfer power between the two shells. There can be other examples of locking systems to effectively connect the plantar and dorsal shells 42 and 44 in other embodiments. Accordingly, the engagement between the plantar shell 42 and the dorsal shell 44 create a very secure and tight interlocking of the shells in the lateral and/or longitudinal directions (e.g., X-Y directions) while still allowing for significant adjustability of the dorsal shell 44 atop the wearer's foot in the vertical position (e.g., Z direction) relative to the plantar shell 42. This adjustability in the Z direction provides the wearer with significant control regarding the desired level of precompression from the top of the wearer's foot, while maintaining the highly efficient overall force transfer in the caging system provided by the tight interlocking of the plantar and dorsal shells 42 and 44 relative to the X-Y directions. This locked engagement also allows adjustability of the dorsal shell 44 relative to the plantar shell 42 with substantially no deformation of the dorsal shell 44 and the fit on the wearer's foot.

Figure 2F:
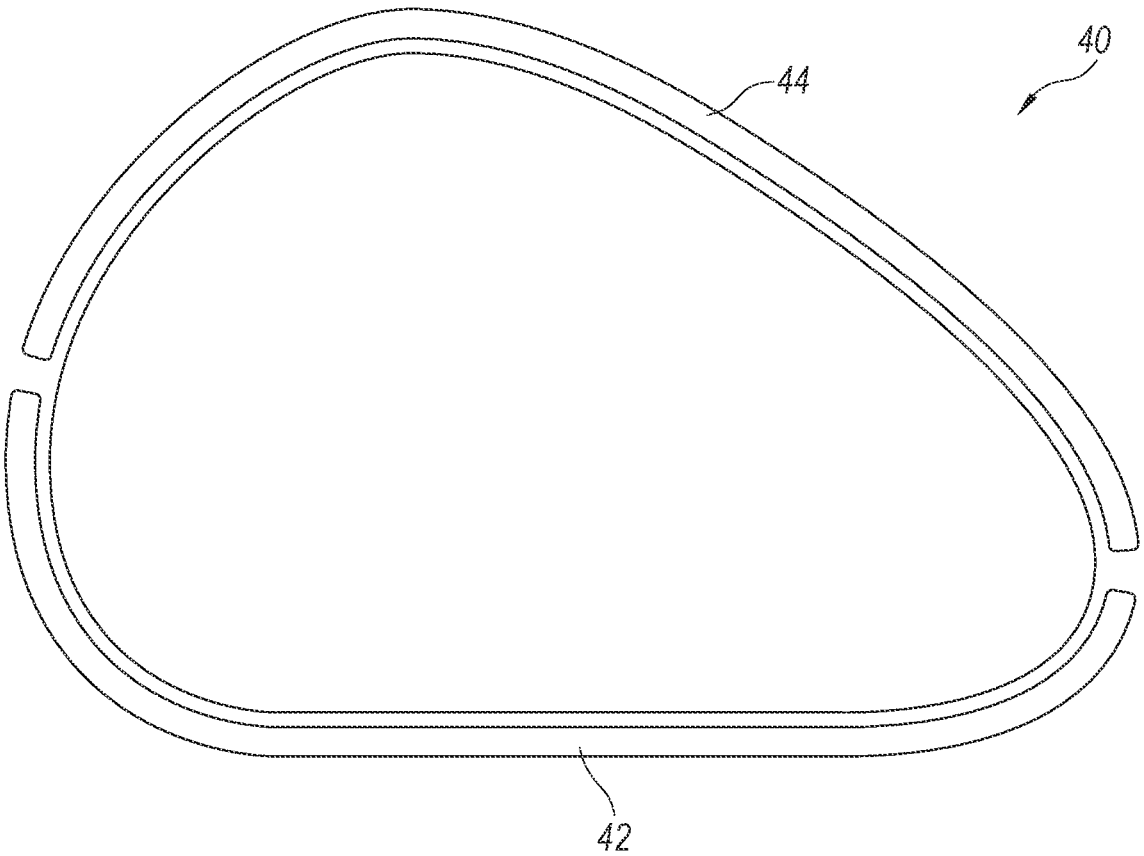

The separation line between the plantar shell 42 and dorsal shell 44 can also be partway up the medial and lateral side walls 52 and 50, as seen in FIG. 2F. This results in the plantar and dorsal shells 42 and 44 being more equal "halves", which comprise a clamshell structure that cups the foot from the bottom and top. All constraining features between the plantar shell 42 and dorsal shell 44 can still apply to this configuration to effectively transfer power between the two shells 42 and 44, but in this configuration a greater percentage of the surface area of the foot is covered by the dorsal shell 44.

The footwear of the illustrated embodiment is 3-D printed using a fiber-reinforced material, such as a printable carbon fiber composite material. The arrangement of the material, including material thickness and reinforcement arrangements, can be precisely controlled to provide a stiff, lightweight, and strong footwear specifically personalized for a wearer based on the 3-D scan of the wearer's foot. In some embodiments, the plantar and dorsal shells 42 and 44 can be made of fiber-reinforced 3-D printing material from Orbital Composites, Inc., although other materials from other sources could be used. In some embodiments, the 3-D scan is obtained using a scanning system from Scandy, LLC, although other 3-D scan systems can be used to obtain the specific data about the foot's shape, size, and contours needed to build the personalized footwear. For example, some embodiments could use a 3-D mold, impression, or layup of the wearer's foot to provide 3-D model data for manufacturing the personalized footwear.

Building the personalized plantar shell 42 and the dorsal shell 44 via 3-D printing or one or more other additive or non-additive manufacturing processes to very closely correspond to the wearer's foot allows the footwear assembly 40 to have the caging system 45 with a precise biometric fit to the wearer's foot. This minimizes the excess space around the foot within the caging system 45. As a result, the footwear assembly 40 does not need to sacrifice stiffness for purposes of comfort. Further, the dorsal shell's configuration that pre-compresses the foot's instep portion 22 (FIG. 2C) and that provides the planar alignment with the plantar shell 42 allows for precise and efficient force and load transfer to and from the footwear assembly 40, during activities, including high performance activities. At least some of the plantar shells and/or the dorsal shells described herein can be formed separately, for example, as discrete components. Additionally, at least some of the plantar shells and/or the dorsal shells described herein can be formed together, for example, as a single or unitary assembly in which the plantar shell is coupled to dorsal shell (and/or the dorsal shell is coupled to the plantar shell) such that the unitary plantar and dorsal shells can later be separated from each other into discrete components.

In some embodiments, the plantar shell 42 and/or the dorsal shell 44 can have an external shell material and a selected inner liner, such as neoprene, a textile material, a non-textile material, a foam/padding, or other liner feature on the inside surface of the associated shell. The footwear assembly 40 can also have a seal 72 or other interface member around the plantar shell's opening 54 or around the dorsal shell's edge portion 66. The seal 72 is positioned to be firmly captured between the plantar and dorsal shells 42 and 44 when the dorsal shell 44 is in the closed position. The seal 72 is configured to facilitate in locating or aligning the dorsal shell 44 with the plantar shell 42 around the opening 54 and to accommodate for any manufacturing tolerances between the components. The seal 72 can be configured to provide a watertight barrier to prevent water and other materials from passing through the joint between the dorsal shell 44 and the plantar shell 42.

The seal can be an elastomeric material compressed between the plantar and dorsal shells 42 and 44, although other materials can be used. The seal 72 also provides a frictional engagement to enhance the interface between the locking features 64 and 65 of the plantar and dorsal shells 42 and 44, thereby preventing relative movement between the plantar shell's engaging portion 62 and the dorsal shell's edge portion 66 when the dorsal shell 44 is in the closed position. Accordingly, when the dorsal shell 44 is in the closed position, the wearer's foot is fully contained and engaged within the caging system 45 of the footwear assembly 40.

Figure 3B:
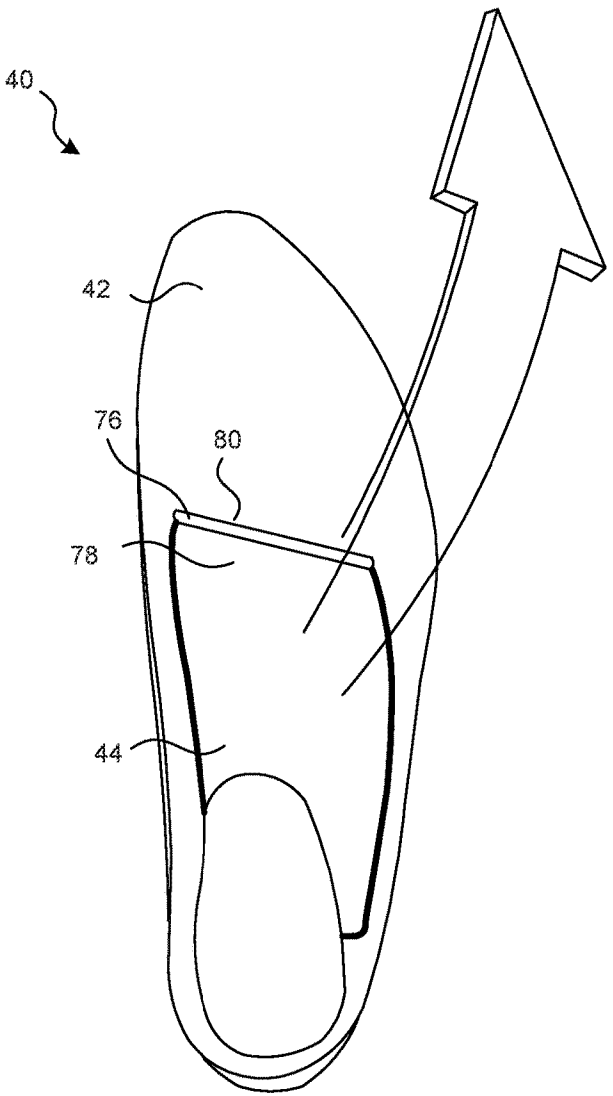
FIGS. 3A and 3B are isometric and top plan views, respectively, of the footwear assembly of FIG. 2A with a front edge portion of a dorsal shell hingedly attached to a plantar shell.
Figure 3A:
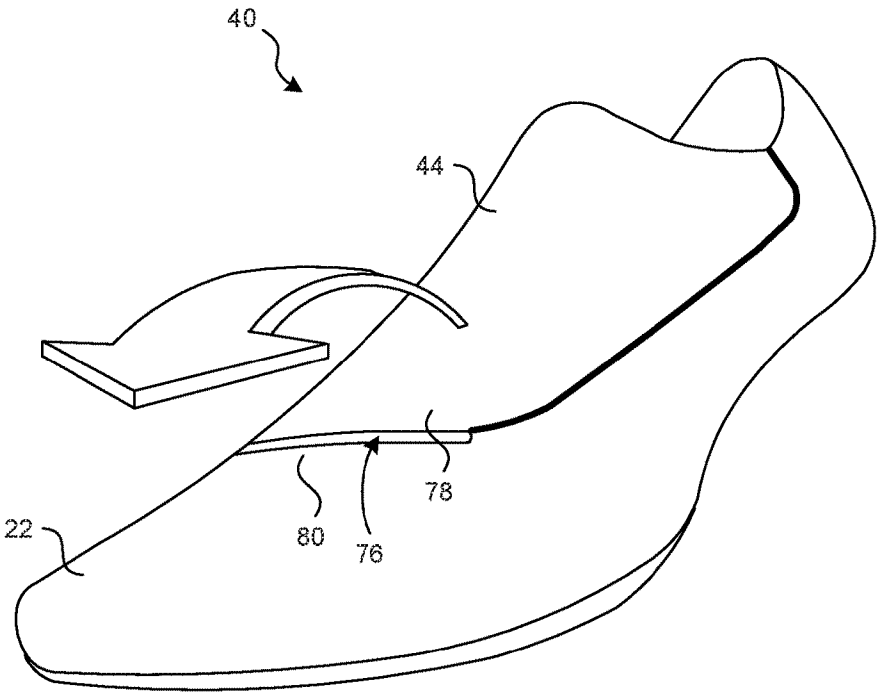

In some embodiments, the dorsal shell 44 can be pivotally attached to the plantar shell 42 to allow for movement of the dorsal shell 44 between the open and closed positions. As seen in FIGS. 3A and 3B, the illustrated footwear assembly 40 has a hinge 76 or other pivoting member coupled to the forward edge portion 78 of the dorsal shell 44 and to the adjacent edge portion 80 of the plantar shell 42 above the foot's forefoot portion 28 (FIG. 1). The hinge 76 may be a living hinge, a pinned hinge, or other hinge mechanism that allows the dorsal shell 44 to move between the open and closed positions.

Figure 4C:
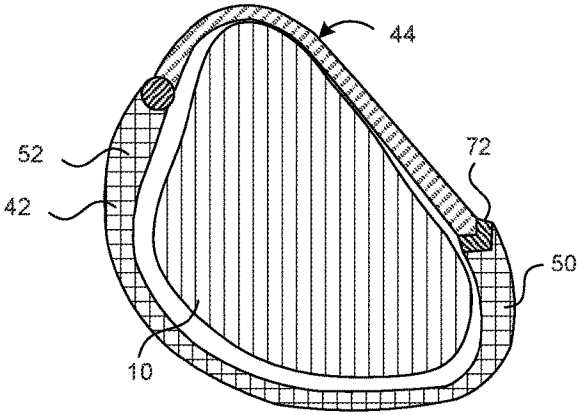
FIG. 4C is a cross-sectional view taken substantially along line 4C-4C of FIG. 4B.
Figure 4B:
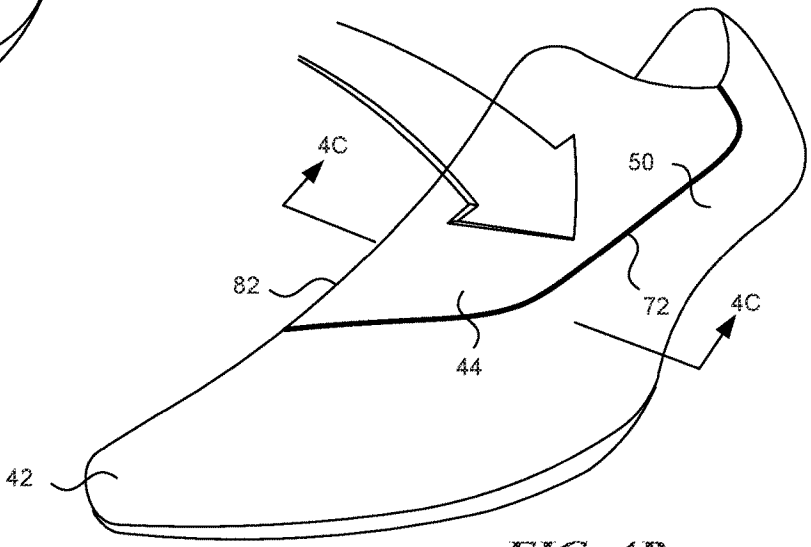
FIG. 4B is an isometric view of the footwear assembly of FIG. 4A with the dorsal shell shown in a closed position.
Figure 4A:
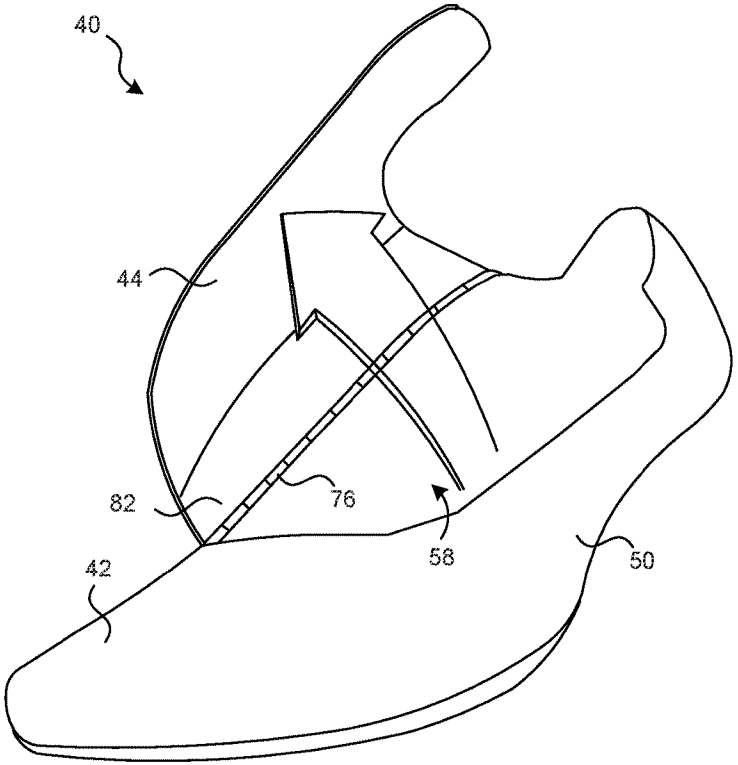
FIG. 4A is an isometric view of the footwear assembly of FIG. 2A with a medial edge portion of the dorsal shell pivotally attached to the plantar shell, and with the dorsal shell shown in an open position.

In another embodiment shown in FIGS. 4A-4C, the hinge 76 can be on the medial side of the footwear assembly 40 and coupled to the plantar shell's medial sidewall 52 and to the medial edge portion 82 of the dorsal shell 44. The hinge 76 can extend along the full length of the dorsal shell's medial edge portion 82, or along only a segment of the medial edge portion 82. Alternatively, the hinge 76 can include two or more spaced apart hinge segments that pivotally interconnect the dorsal shell 44 with the medial sidewall 52 of the plantar shell 42.

Figure 5C:
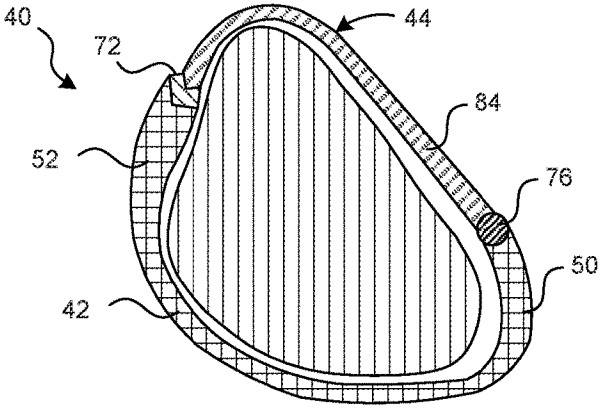
FIG. 5C is a cross-sectional view taken substantially along line 5C-5C of FIG. 5B.
Figure 5B:
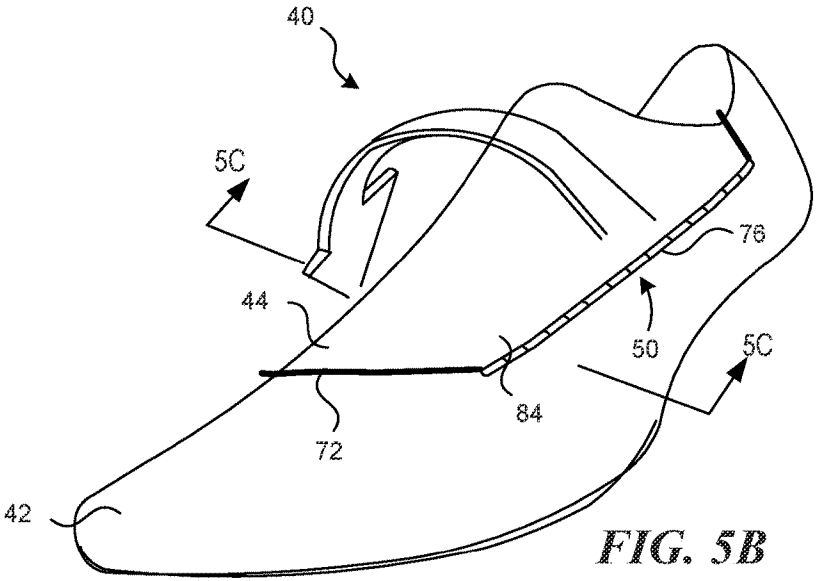
FIG. 5B is an isometric view of the footwear assembly of FIG. 5A with the dorsal shell shown in the closed position.
Figure 5A:
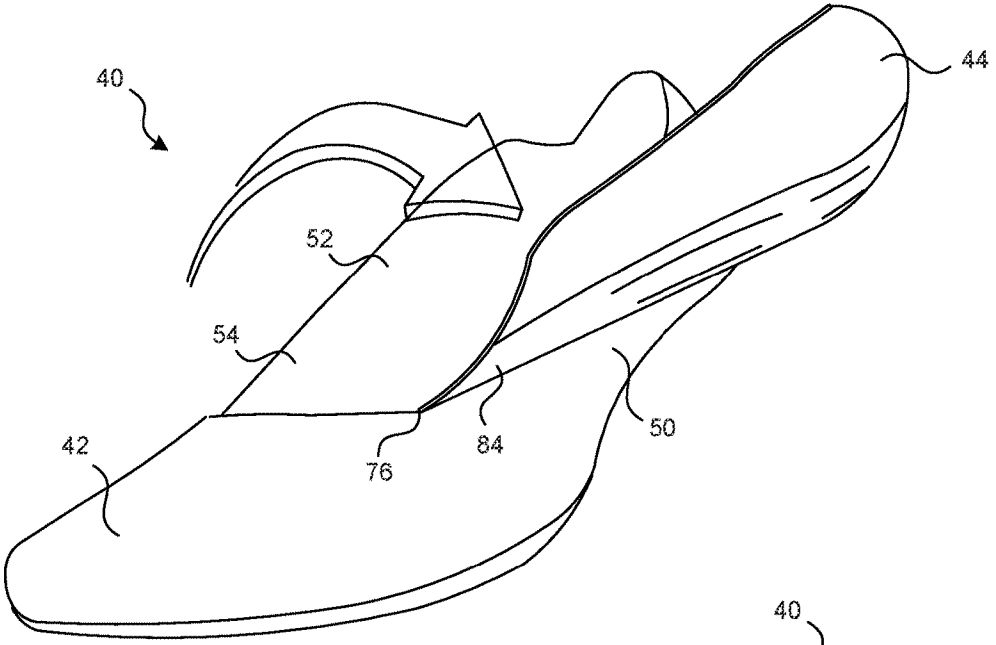
FIG. 5A is an isometric view of the footwear assembly of FIG. 2A with a lateral edge portion of the dorsal shell pivotally attached to the plantar shell, and with the dorsal shell shown in the open position.

In another embodiment shown in FIGS. 5A-5C, the hinge 76 can be on the lateral side of the footwear 40 and coupled to the plantar shell's lateral sidewall 50 and to the lateral edge portion 84 of the dorsal shell 44. The hinge 76 can extend along the full length of the dorsal shell's lateral edge portion 84, or along only a segment of the lateral edge portion 84. Alternatively, the hinge 76 can include two or more spaced apart hinge segments that pivotally interconnect the dorsal shell 44 with the lateral sidewall 50 of the plantar shell 42.

As seen in FIGS. 6A-7B, the footwear assembly 40 has a closure device 88 coupled to the caging system 45 to releasably hold the dorsal shell 44 securely against the plantar shell 42 in the closed position. The closure device 88 is movable between locked and released positions and can be adjustable to control the force with which the dorsal shell 44 is held against the plantar shell 42 and against the foot's instep portion 22 (FIG. 1). When the closure device 88 is in the released position, the dorsal shell 44 can be moved between the closed and opened positions. When the closure device 88 is in the locked position with the dorsal shell 44 in the closed position, the closure device 88 blocks the dorsal shell 44 from moving away from the closed position. Accordingly, the closure devices 88 lock the dorsal shell 44 in firm engagement with the plantar shell 42, so as to form the continuous rigid shell around the wearer's foot 10 in a precise, personalized fit without sacrificing stiffness of the caging system 45.

Figure 6B:
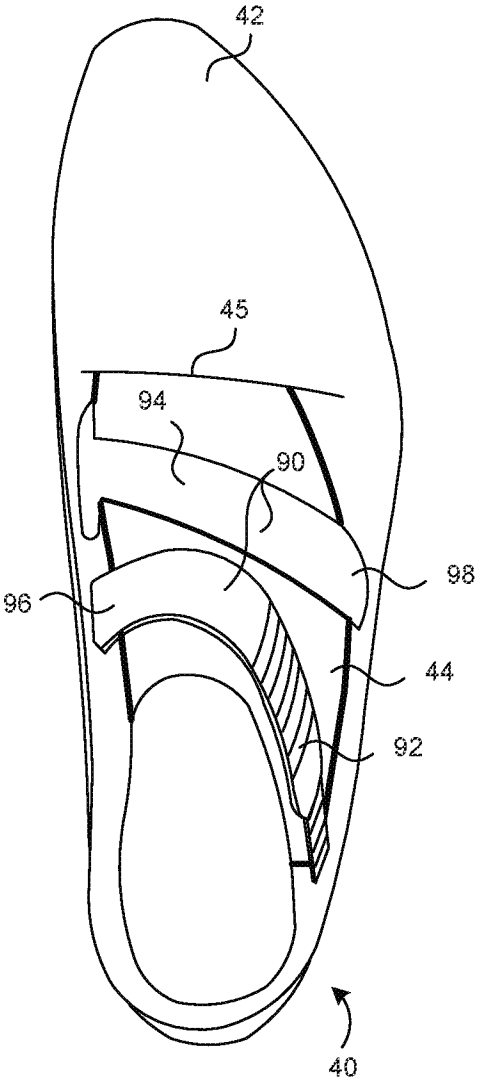
FIGS. 6A and 6B are isometric and top plan views, respectively, of the footwear assembly of FIG. 2A with a closure system comprising one or more buckles and straps.
Figure 6A:
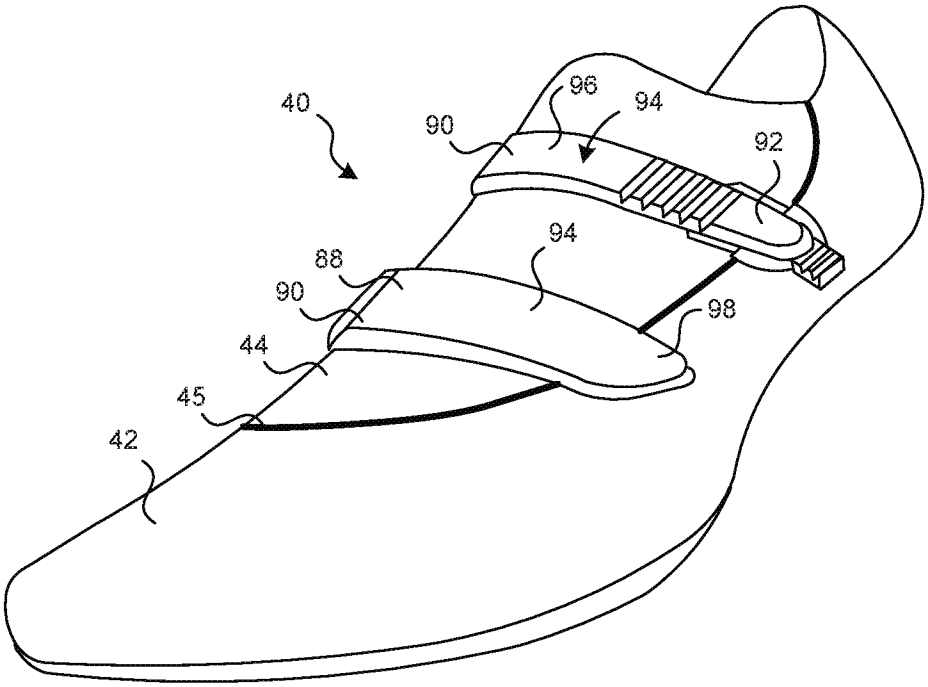

In the embodiment illustrated in FIGS. 6A and 6B, the closure device 88 comprises one or more closable straps 90 anchored to the plantar shell 42, such as along the medial and lateral sidewalls 52 and 50 adjacent to the opening 54. The straps 90 are configured to extend over the dorsal shell 44 when in the closed position. The straps 90 can be retained in the locked position through a buckle feature 92 or other retention mechanisms, such as hook-and-loop material 94 (Velcro®), a ratchet closure system, or other closure mechanisms. The footwear assembly 40 can include a plurality of closure devices 88, and in other embodiments a single closure device 88 can be used.

A footwear assembly 40 can include multiple closure devices that can be of the same type or can be different types. For example, in the embodiment of FIGS. 6A and 6B, the footwear assembly 40 is a cycling shoe with a rearward strap 96 extending over the dorsal shell 44 above the foot's instep portion 22 (FIG. 1). A forward strap 98 extends over the dorsal shell 44, generally above the forefoot portion 28 (FIG. 1). The rearward strap 96 of the illustrated embodiment includes a buckle feature 92, such as a ratchet buckle system, while the forward strap 98 comprises a hook-and-loop material 94 that releasably holds the forward strap 98 in the locked position.

Figure 7B:
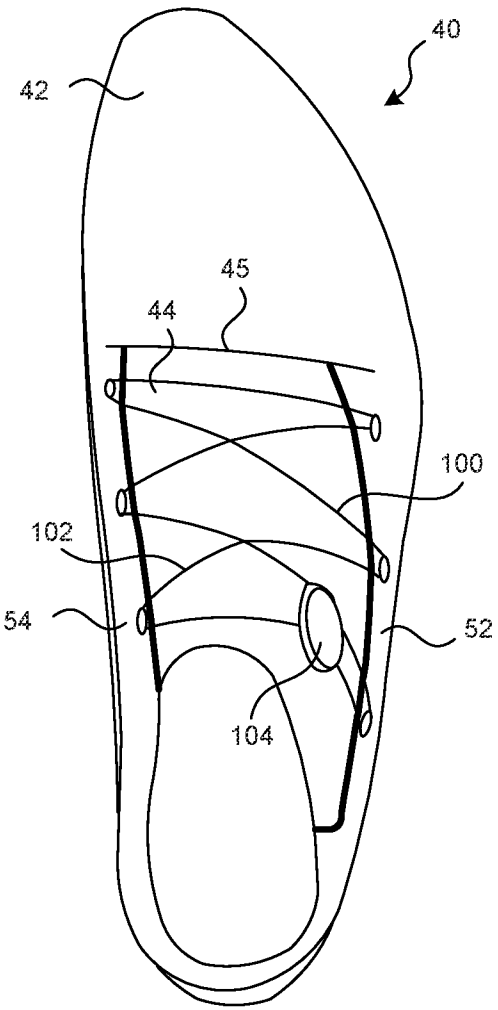
FIGS. 7A and 7B are isometric and top plan views of the footwear assembly of FIG. 1 with a closure system comprising a closure mechanism.
Figure 7A:
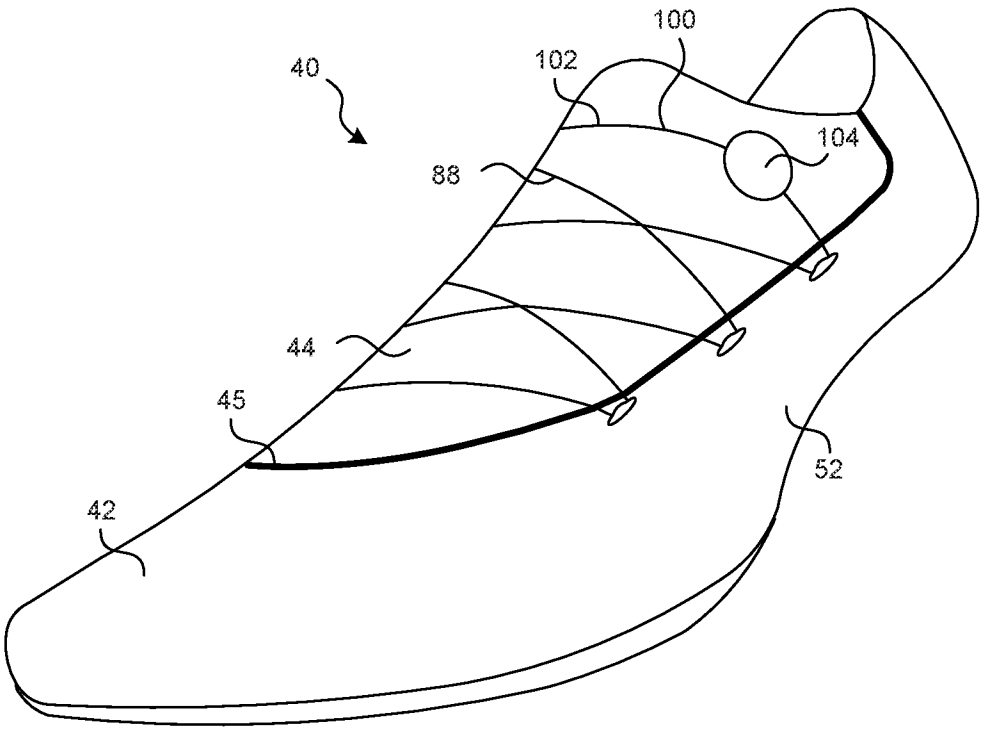
Figure 8B:
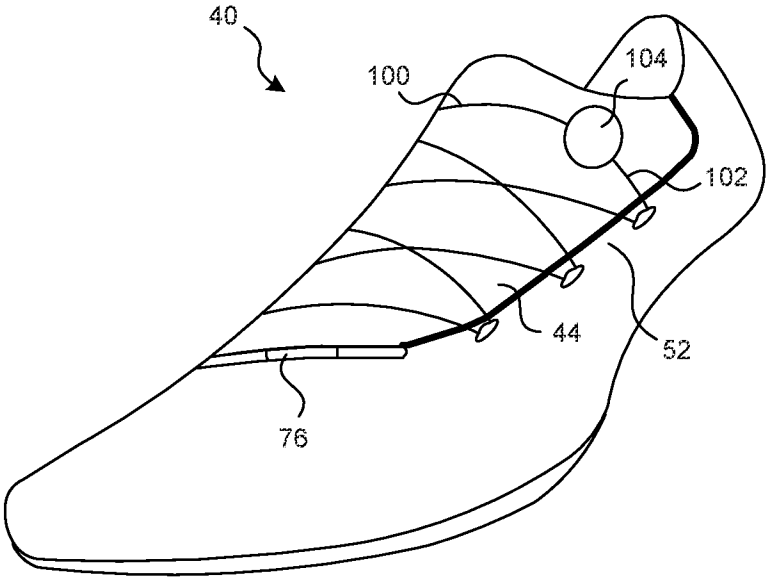
FIG. 8B is an isometric view of the footwear assembly of FIG. 8A with the dorsal shell shown in the closed position.
Figure 8A:
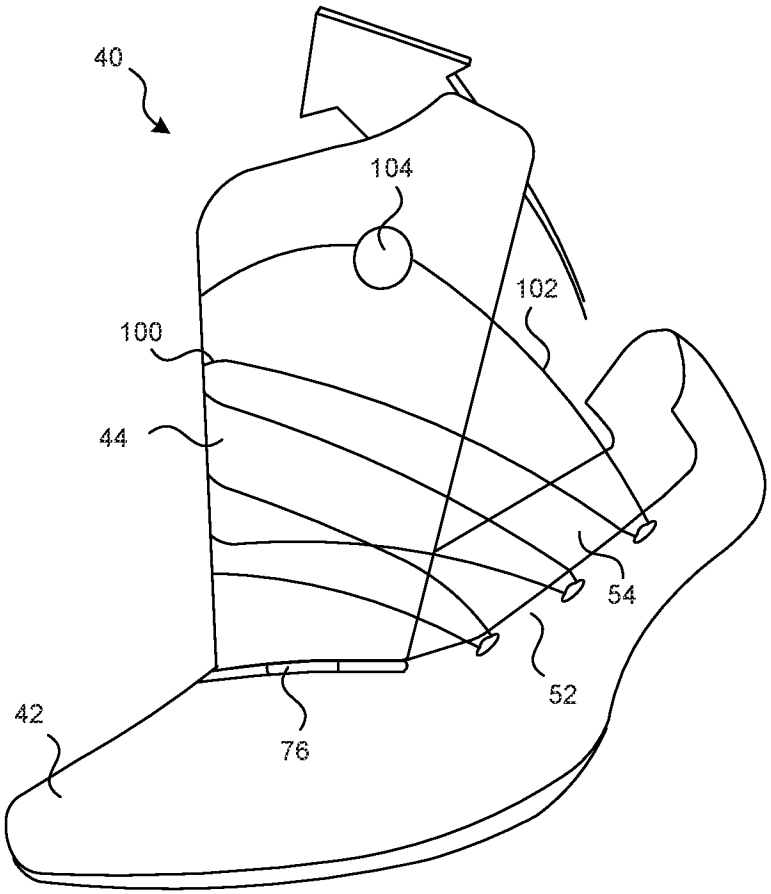
FIG. 8A is an isometric view of the footwear assembly of FIG. 7A with the dorsal shell shown in the open position.

In another embodiment shown in FIGS. 7A-7B, the closure device 88 can be a releasable cable and dial system, such as a closure system provided by Boa Technology Inc., referred to herein as a Boa closure 100. The Boa closure 100 has the cable 102 anchored in a plurality of locations on the medial and lateral sidewalls 52 and 50 of the plantar shell 42. The cable 102 is attached to the adjustment dial 104 configured to tighten or loosen the cable 102 over the dorsal shell 44. As seen in FIG. 8A, when the Boa closure 100 is loosened, the dorsal shell 44 can be moved between the closed and opened positions. When the adjustment dial 104 is activated to tighten the cable 102, the cable 102 tightens over the dorsal shell 44 and locks the dorsal shell 44 in the closed position.

Figure 9C:
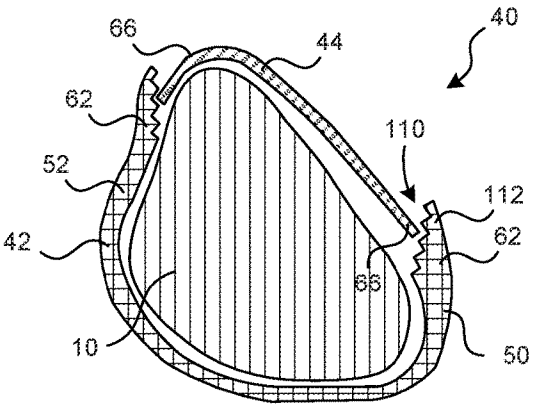
FIG. 9C is a cross-sectional view taken substantially along line 9C-9C of FIG. 9B.
Figure 9B:
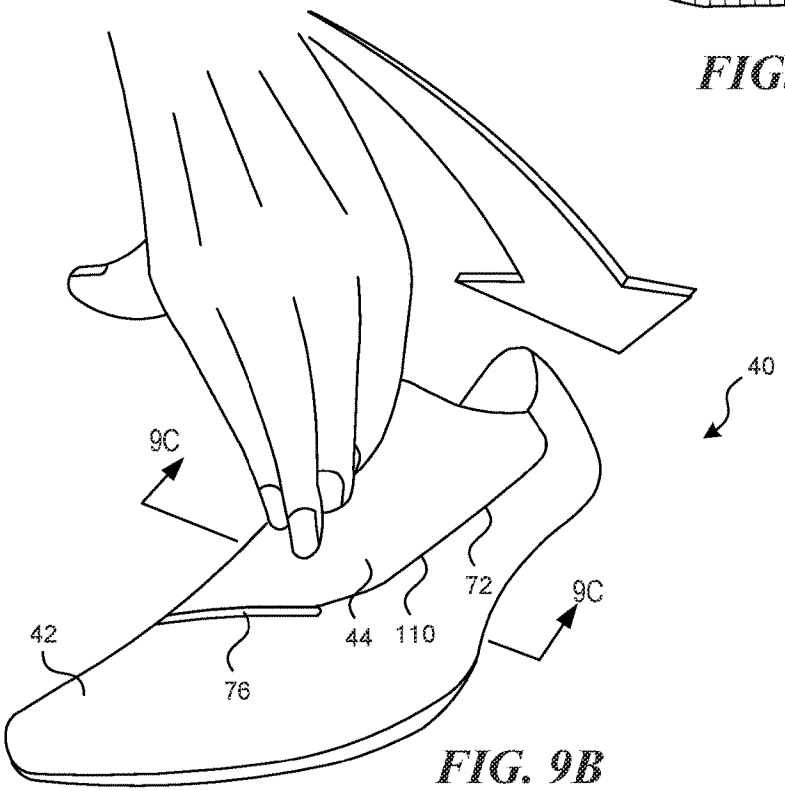
FIGS. 9A and 9B are isometric views of a footwear assembly of the present technology with a quick closure system, and with the dorsal shell shown in the open and closed positions, respectively.
Figure 9A:
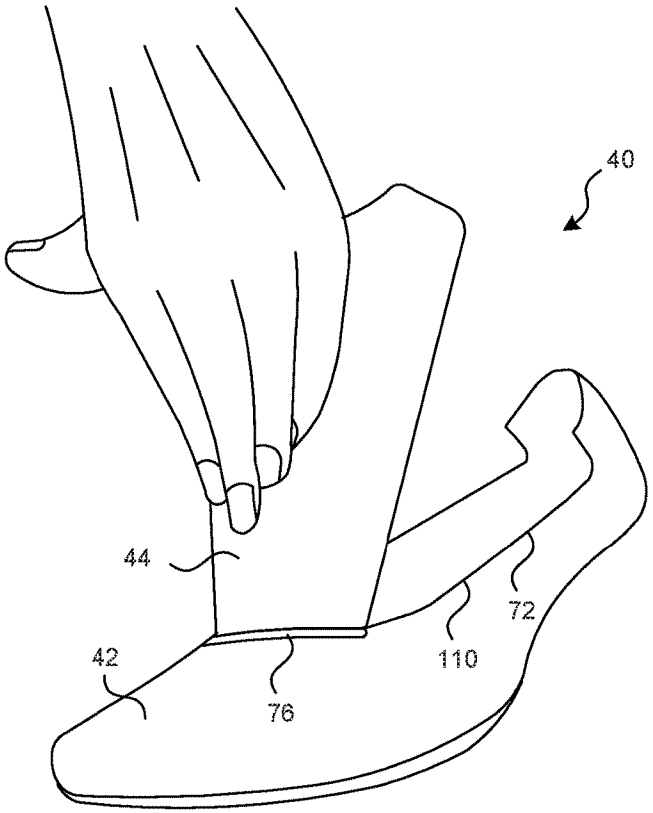

FIGS. 9A and 9B are isometric views of a footwear assembly 40 of another embodiment that has the plantar and dorsal shells 42 and 44 as discussed above and have an integrated quick closure mechanism 110 to releasably hold the dorsal shell 44 in the closed position. The footwear assembly 40 can be, for example, a performance triathlon shoe that allows the wearer to very quickly put on or take off the shoe, while providing the personalized precision fit with the pre-compression of the wearer's instep. The quick closure mechanism 110 can be moved between released and locked positions. In the released position, the quick closure mechanism 110 allows the dorsal shell 44 to move to the open position, so the wearer can insert his or her foot into the plantar shell 42. The dorsal shell 44 can be manually pressed from the open position into the closed position so as to automatically engage and move the quick closure mechanism 110 to the locked position.

As seen in FIG. 9C, an embodiment of the quick closure mechanism 110 can include a series of stepped, ratchet teeth 112 on the plantar shell's engaging portion 62 around some or all of the opening 54. The stepped, ratchet teeth 112 lockably the engage with the edge portion 66 of the dorsal shell 44 to securely hold the dorsal shell in the closed position. In another embodiment, the ratchet teeth 112 configuration can be provided on the dorsal shell 44, rather than the plantar shell 42. The dorsal shell 44 can be manually pressed downward to engage the quick closure mechanism so as to pre-compress the foot's instep portion 22. When the wearer wants to remove the shoe, the perimeter shell's engaging portion 62 can be flexed outwardly so as to disengage the ratchet teeth 112 from the dorsal shell 44. Once the ratchet teeth 112 are disengaged, the dorsal shell 44 can be moved from the closed position to the open position, thereby allowing the wearer to quickly and easily remove his or her foot from the shoe. In other embodiments, other integrated quick closure mechanisms can be used for quick locking and releasing of the dorsal shell 44 from the plantar shell 42.

The closure systems illustrated in FIGS. 6A-9C are only examples of some of the closure systems that can be used in the present technology. Other embodiments can include one or more closure mechanisms coupled to the caging system 45 to releasably hold the dorsal shell 44 securely in position relative to the plantar shell 42 in the closed position and that can be adjustable to control the force with which the dorsal shell 44 is held against the plantar shell 42 and/or against the foot's instep portion 22 (FIG. 1). Other examples of closure systems could include webbings, textile straps, buckles typically used in ski boots, cables, etc. In other embodiments, the dorsal shell 44 can be configured to engage with the plantar shell 42 and move between the open and closed positions without the use of a hinge. For example, the plantar or dorsal shell 42 or 44 can use a rail, post, or other alignment system for movement and interface between the plantar and dorsal shells, which may or may not have a hinged connection between them.

Figure 10A:
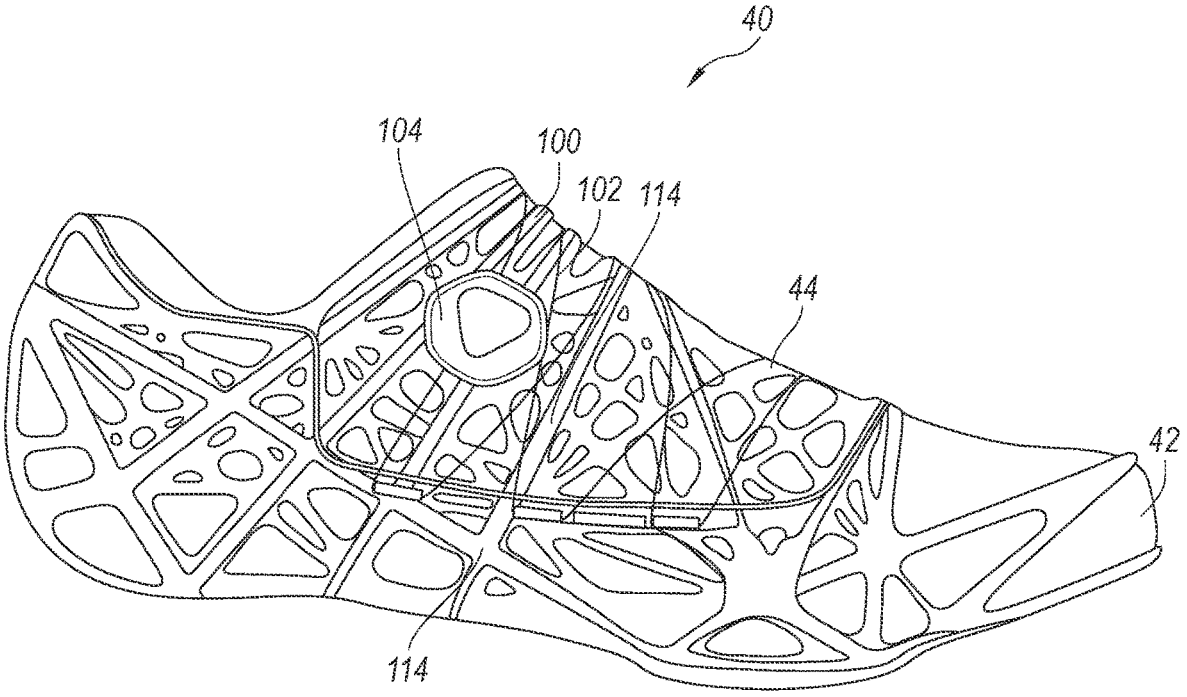
FIG. 10A is a side view of a cycling shoe in accordance with another embodiment of the present technology.

FIG. 10A is a side view of footwear assembly 40 in accordance with another embodiment of the present technology. In this embodiment, the illustrated footwear assembly is a cycling shoe with the plantar and dorsal shells 42 and 44 as discussed above. The illustrated closure device 88 is a Boa closure 100, although other closure devices could be used. The plantar shell 42 and dorsal shell 44 are manufactured with a 3-D printing or other additive or non-additive manufacturing technology using a fiber-reinforced, high-strength polymer. The plantar and dorsal shells 42 and 44 each have a plurality of integral reinforcement ribs 114 positioned and oriented at selected areas to control the force distribution and load paths in the shoe. Reinforcement ribs 114 of the plantar shell 42 in the illustrated embodiment can align with the reinforcement ribs 114 of the dorsal shell 44 when in the closed position, thereby providing precise load distribution between the plantar and dorsal shells 42 and 44. The reinforcement ribs 114 can be provided in areas of the shoe at selected orientations, thicknesses, and lengths so as to selectively direct the forces through the shoe during use. As a result, other areas of the plantar and/or dorsal shells 42 and 44 can have a reduced thickness and can be manufactured with less material. This construction provides for a personalized shoe with a precision fit and that is stiff and strong, yet extremely lightweight.

Figure 10B:
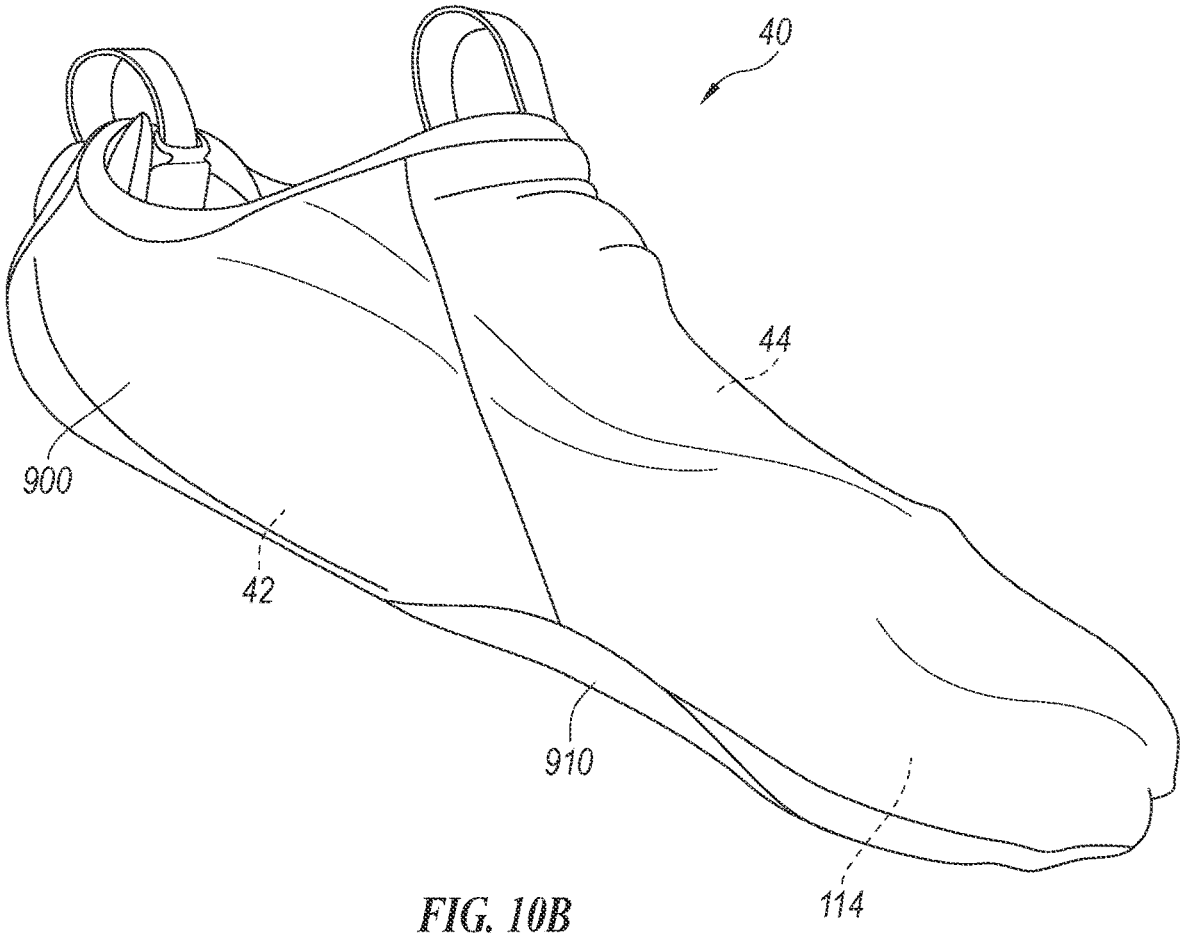
FIGS. 10B and 10C are isometric views of a shoe, such as a cycling shoe, in accordance with another embodiment of the present technology.
Figure 10C:
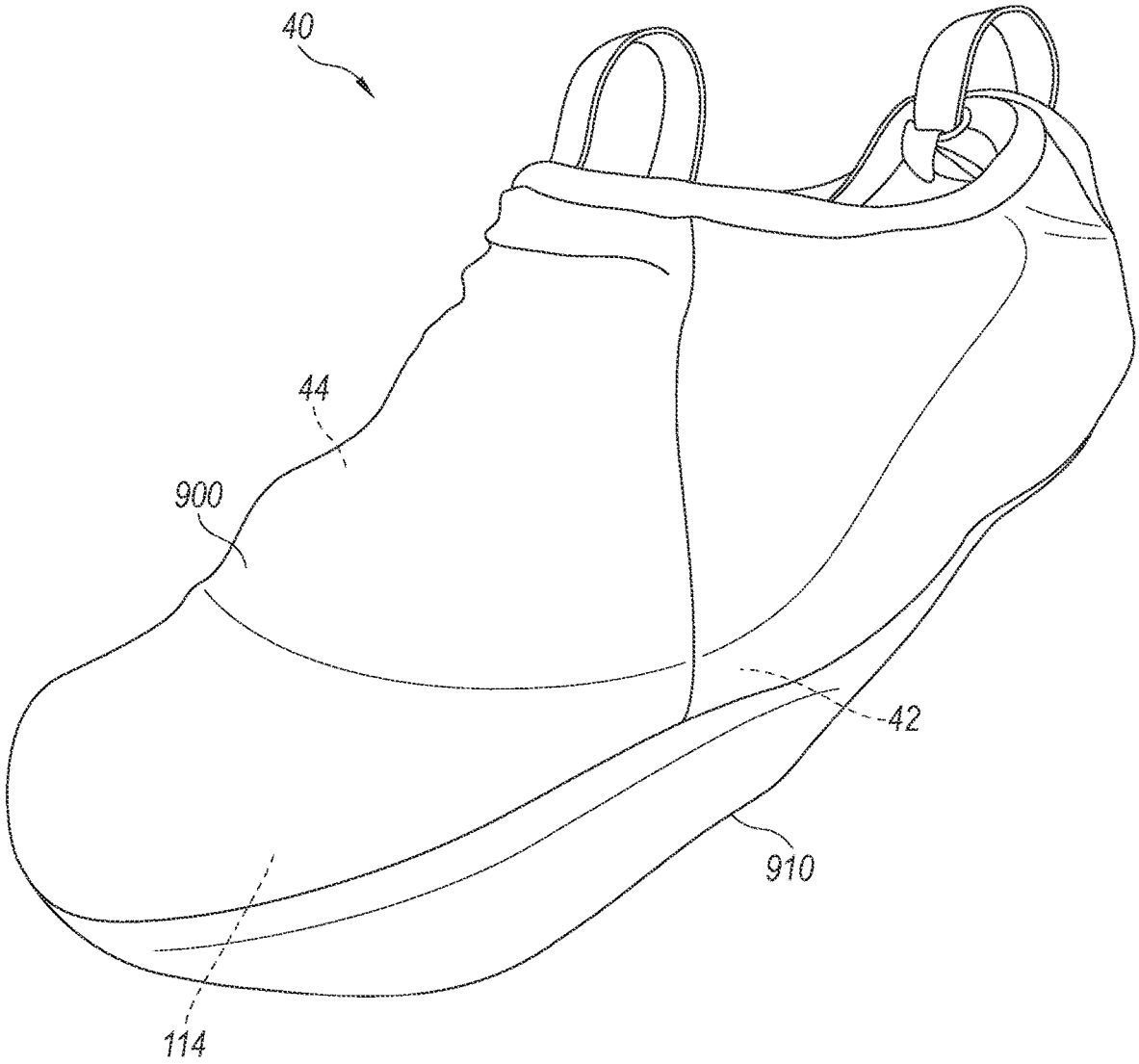
Figure 10D:
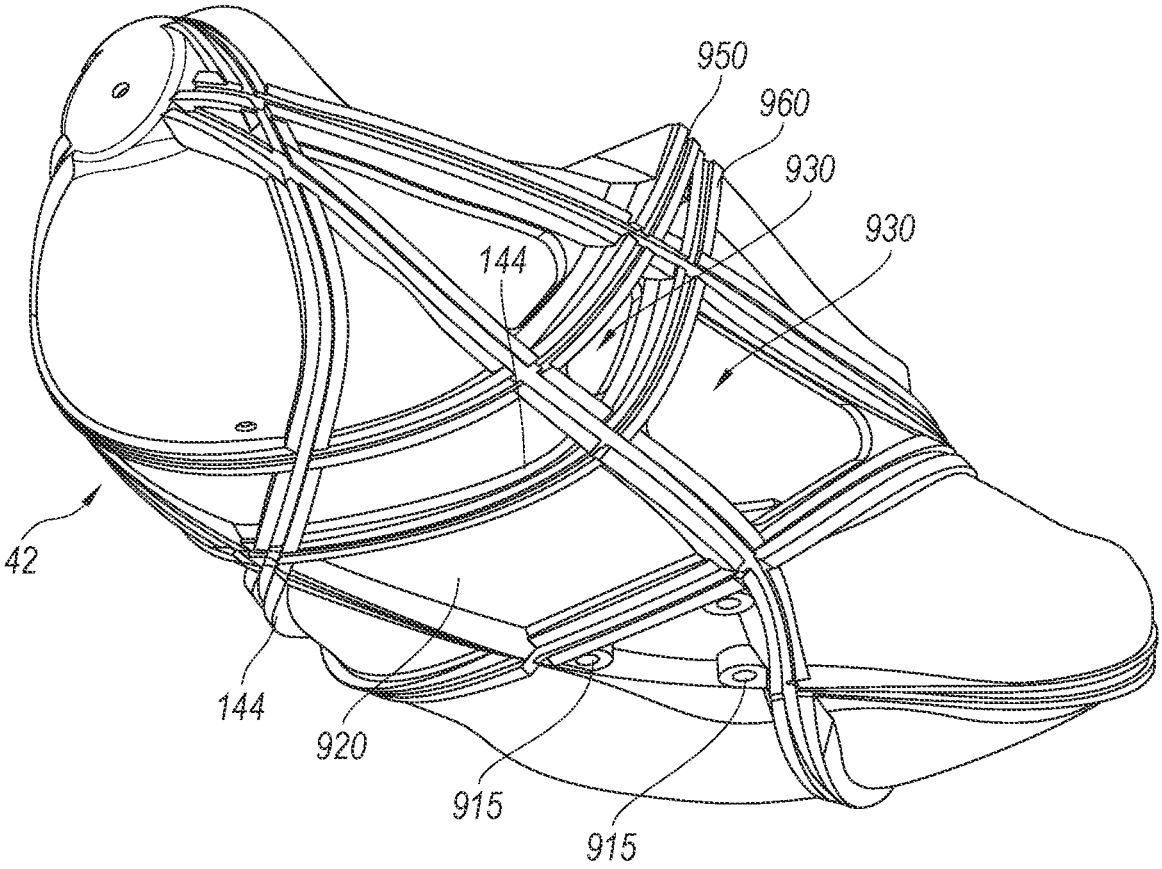
FIG. 10D is a rear isometric view of a plantar shell of the shoe of FIGS. 10B & 10C, wherein an outer cover layer is removed to illustrate the plantar shell with reinforcing ribs or struts.
Figure 10E:
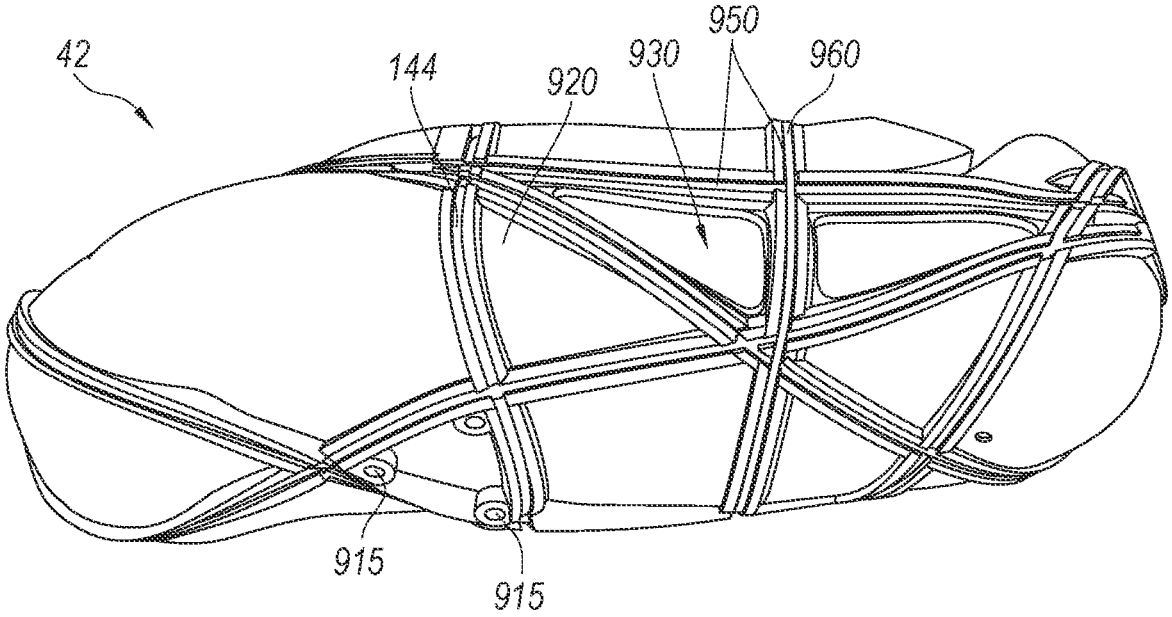
FIGS. 10E-10G are bottom isometric views of the plantar shell of FIG. 10D.
Figure 10F:
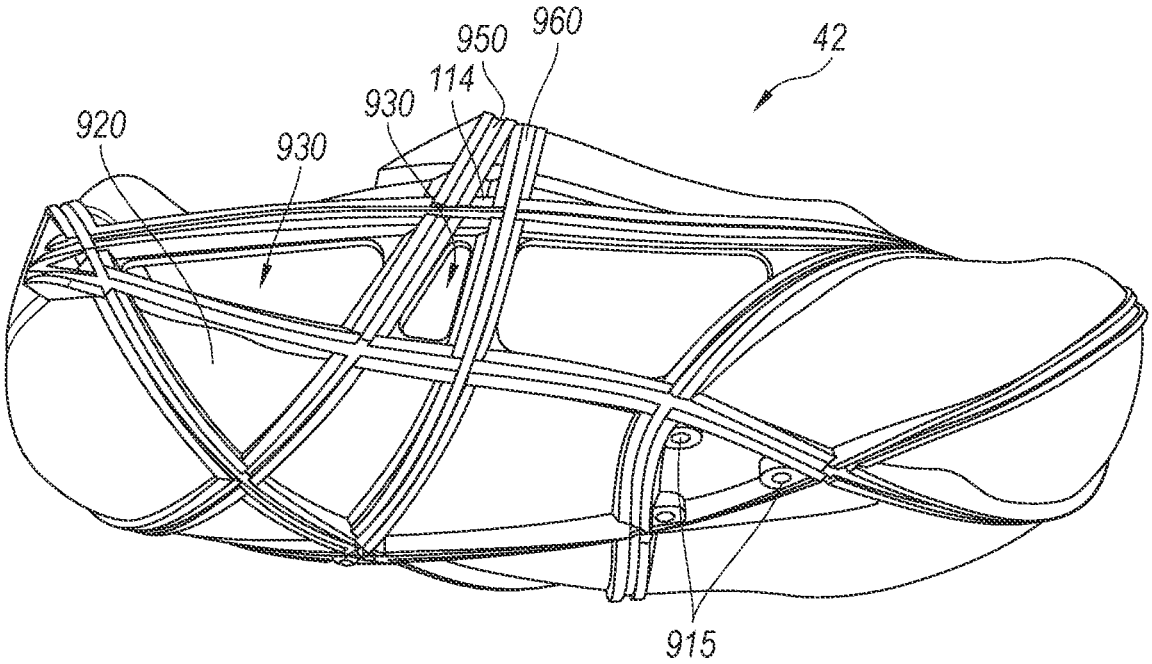
Figure 10G:
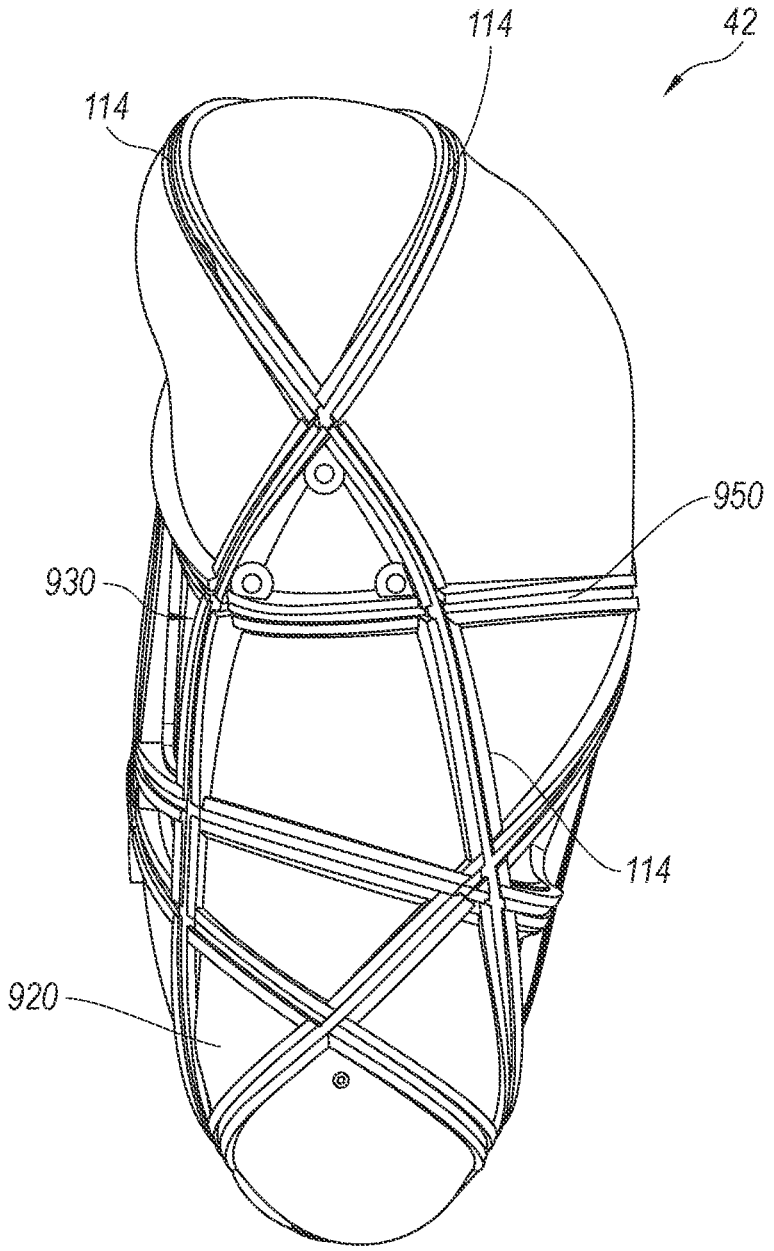

FIGS. 10B and 10C are isometric views of a footwear assembly 40, shown as a cycling shoe, with a flexible outer cover 900 over the plantar shell 42 and dorsal shell 44. In the illustrated embodiment, the outer cover 900 is a fabric or textile cover removably positioned to cover and substantially enclose the plantar and dorsal shells 42 and 44. The cover 900 can be an insulative material, such as a neoprene material or the like. In other embodiments, the cover 900 can be a waterproof or water-resistant material. The flexible cover 900 on the cycle shoe has an opening 910 on the bottom side that exposes the cleat assembly attached to the bottom of the plantar shell 42. The opening 910 also allows access to the mounting holes 915 in the bottom of the plantar shell 42 that receive the fasteners of the cleat assembly while the cover 900 is installed. This allows the cleat assembly to be adjusted or changed without having to remove the outer cover 900 from the rest of the shoe.

FIGS. 10D-10G are isometric views of the plantar shell 42 of the footwear 40 of FIGS. 10B and 10C. The plantar shell 42 of the illustrated embodiment is formed with a plurality of reinforcement ribs 114 extending along selected portions of the shell. The precise positioning and location of the ribs 114 is based on the 3-D scan or other shape information about the wearer's foot, as discussed above, so as to avoid uncomfortable pressure points on the wearer's foot during use. The ribs 114 are also positioned to provide the stiffness and force reaction structures at portions of the plantar shell 42 for efficient force transfer while maintaining comfort for the wearer's foot while cycling or other use. The dorsal shell 44 (not shown) can have similar reinforcement ribs 114 aligned and mating with ribs 114 on the plantar shell 42 to facilitate force and load transfer across the connection between the plantar and dorsal shells 40 and 42. The dorsal shell 44 in other embodiments could have independent reinforcement ribs that do not line up with the reinforcement ribs on the plantar shell 42.

The area between the reinforcement ribs 114 can be formed by a very thin material forming a web 920 between the ribs, such that the ribs 114 extend outwardly and stand proud from the web material. In some embodiments, such as when the shoe or a portion thereof is made using an additive manufacturing process, a thin seed layer is formed based on the shape information for the particular wearer's foot, and the ribs 114 are formed atop and extend from the seed layer, so the ribs extend and stand proud from the seed layer. Accordingly, the seed layer material between the ribs 114 forms with thin webs 920 between the ribs 114. In other embodiments, the seed layer can be formed by another manufacturing process, such as a vacuum molding or injection molding process and the ribs 114 are formed atop the seed layer.

Some or all of the areas between the reinforcement ribs 114 can be free of material, so the plantar shell 42 and/or the dorsal shell 44 has open holes 930 between the ribs 114. In the embodiment wherein a seed layer is formed and the ribs 114 are formed atop the seed layer, the seed layer can be formed with the holes 930 in locations corresponding to areas between the ribs 114. The construction with the holes 930 between the ribs 114 results in a very lightweight shoe that is shaped and sized to the individual wearer's foot without sacrificing the comfort, stiffness, and force transfer abilities of the shoe. In yet other embodiments, the plantar shell 42 and/or the dorsal shell 44 can be constructed without any web material 920 between the ribs, so all of the spaces between the ribs 114 are open. Accordingly, the plantar shell 42 and/or the dorsal shell 44 is formed by the interconnected ribs 114 that provide a customized exoskeleton around the wearer's foot.

In the illustrated embodiment seen in FIGS. 10D-10G, the ribs 114 are constructed with one or more alignment channels 950 in the outer surface that would be facing away from the wearer's foot. The alignment channels 950 are configured to receive and contain reinforcement fiber material 960, such as carbon fiber materials. In the figures, the reinforcement fibers 960 are shown in only some of the channels 950 for illustrative purposes, and other channels are illustrated without the fibers therein. It is understood that all of the alignment channels 950 in all of the ribs 114 can be filled with the fiber material. In other embodiments, the reinforcement fibers 960 may only be in the channels or portions of the channels in some of the ribs 114, such as in selected area where additional strength and/or stiffness may be desired.

The reinforcement fibers 960 can be laid into the channels 950 along with a matrix material that permanently and structurally affixes to the ribs, so that the reinforcing fibers work with the ribs 114 to maintain the stiffness of the plantar shell 42 and/or the dorsal shell 44. In some embodiments, the ribs 114 can have a central channel 950 formed in the outer surface, although other embodiments can have two or more than channels 950 formed in the rib's outer surface.

The reinforcement fibers 960 and associated carrier matrix, such as an epoxy or other suitable polymer material, can be laid into the channels 950 of the reinforcement ribs 114 by an additive manufacturing or other suitable manufacturing process. The ribs 114 or the channels 950 can be constructed to facilitate the installation or laying in of the reinforcing fibers 960 by forming the ribs 114 so the outer surface of each rib is only convex or flat in the rib's axial direction. Accordingly, the ribs 114 do not have concave areas in the axial direction. This convex configuration of the ribs 114 and associated channels 950 allows the reinforcement fibers 960 to better maintain axial alignment and engagement within the ribs 114 when the fibers 960 are laid into the channels 950. The reinforcement fibers 960 and/or ribs 114 are preferably long sections, in order to distribute forces over greater distances. Conversely, short sections of reinforcement fibers are less effective. Preferably the length of reinforcement fibers 960 and/or ribs 114 are greater than 1" long, more preferably the length is greater than 2", more preferably the length is greater than 4", and more preferably the length is greater than 6". It is also beneficial for the reinforcement fibers 960 and/or ribs 114 to be continuously connected around the footwear, so that one path connects to another and can be created in a continuous motion.

Alternatively, the fiber reinforcement and carrier matrix can be deposited directly onto a mold surface, without the use of any alignment channels. In this case, the mold is removed after forming, and only the composite ribs are remaining.

It is beneficial to add the composite material just along the paths of the reinforcement ribs 114, instead of traditional composite techniques that start with sheets of woven fiber material. Using traditional composite layup techniques, the composite material is added to entire surfaces of the structure, and weight reduction is achieved through post-cutting holes or layups using many pieces which require extra fabrication time. It is preferable, therefore, to place the composite material only along the reinforcement rib paths, which uses less material, reduces weight, cost, and manufacturing time, while still obtaining the benefits of composite materials exactly where they are desired on the plantar shell 42 and/or dorsal shell 44.

Figure 11B:
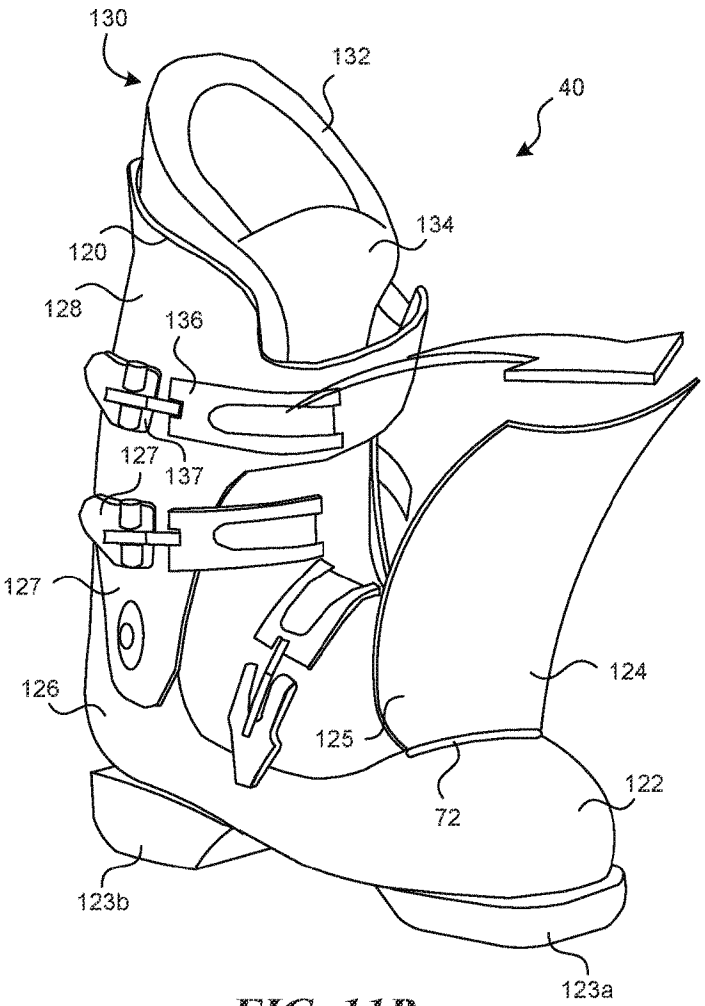
FIG. 11B is an isometric view of the ski boot of FIG. 11A with the dorsal shell shown in the open position.
Figure 11A:
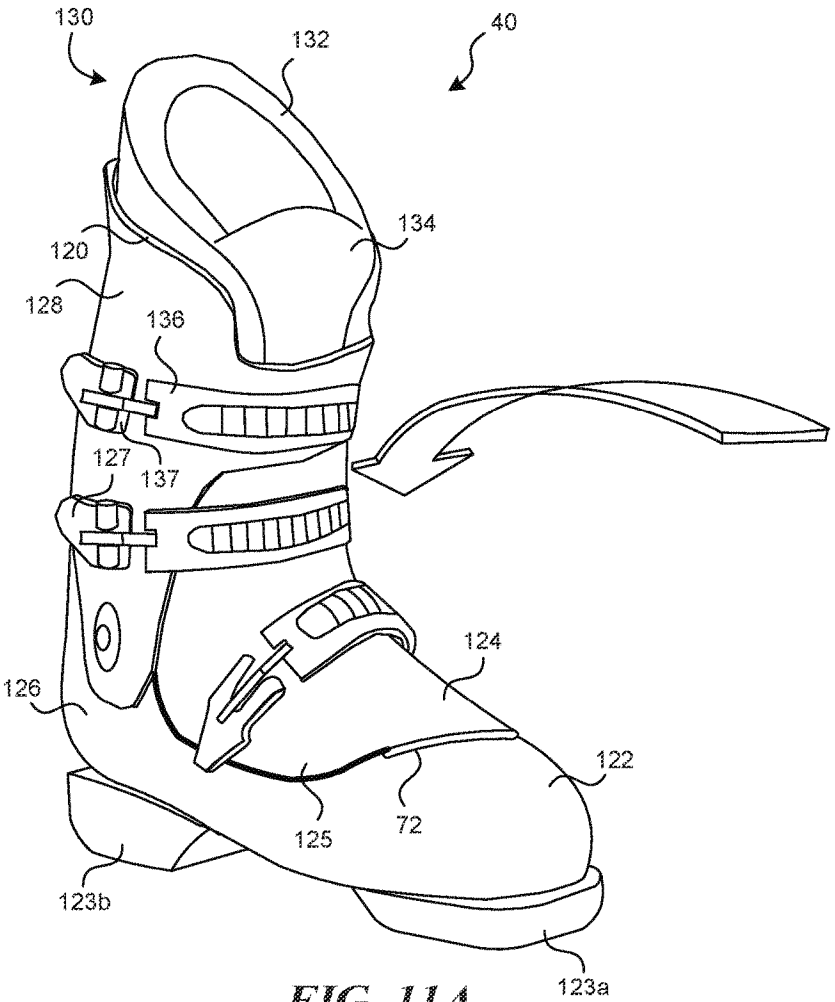
FIG. 11A is an isometric view of a ski boot in accordance with an embodiment of the present technology with the dorsal shell shown in the closed position.

FIGS. 11A and 11B are isometric views of a footwear assembly 40 in the form of a ski boot 120 made in accordance with the present technology. The ski boot has a plantar shell 122 that receives the wearer's foot, and a dorsal shell 124 pivotally or otherwise attached to the plantar shell 122. The dorsal shell 124 is movable between the closed position (FIG. 11A) and the open position (FIG. 11B). The bottom of the plantar shell 122 is integrally connected to toe and heel lugs 123*a* and 123*b* configured to releasably retain the ski boot in conventional ski bindings (not shown). The edge portion 125 dorsal shell 124 securely and precisely engage the plantar shell 122 as discussed above. A seal 72 can be provided at the interface between the plantar and dorsal shells 122 and 124, so as to provide a water-tight caging system.

In the illustrated embodiment, the rear portion of the plantar shell 122 extends upwardly from the rear lug 123*b* and forms a contoured heel cup area 126. The plantar shell's rear portion also extends upwardly and forms an ankle support portion 127. The ski boot 120 also has an upper cuff portion 128 pivotally connected to the ankle support portion 127 generally in alignment with the wearer's ankle. Accordingly, the upper cuff portion 128 can selectively pivot and flex relative to the plantar shell 122 to help control the ankle flex and lower leg movement that occurs when skiing or walking in the ski boot 120.

The ski boot 120 of the illustrated embodiment includes a boot liner 130 with a foot portion that very closely conforms with the wearers foot. The boot liner 130 also has an upper, padded leg portion 132 that receives and wraps around portions of the wearer's ankle and lower leg. The boot liner 130 of the illustrated embodiment also has a padded tongue 134 that aligns with the front of the wearer's ankle and shin. The tongue 134 and padded leg portion 132 can be configured to be at least partially enclosed within the cuff portion 128 and adjacent to an upper portion of the dorsal shell 124 when in the closed position.

The ski boot 120 has a plurality of closure devices 136 configured to releasably engage and hold the dorsal shell 124 firmly in the closed position and against the plantar shell 122. Some of the closure devices 136 are positioned to hold the upper cuff portion 128 closed and firmly around the upper portion of the dorsal shell 124, the padded tongue 134, and the padded leg portion 132, so as to support the wearer's lower leg and ankle. In the embodiment illustrated in FIGS. 11A and 11B, the closure features 136 are buckles 137 that can be ladder or bail catch-style buckles or ratchet strap style buckles. The illustrated embodiment shows three adjustable ladder/catch style buckles with a lower buckle mounted to the plantar and dorsal shells 122 and 124. Two upper buckles are attached to the cuff portion 128. Other embodiments can use other closure devices 136, such as straps, hook-and-loop systems, ratchet systems, and/or a Boa closure.

Figure 11C:
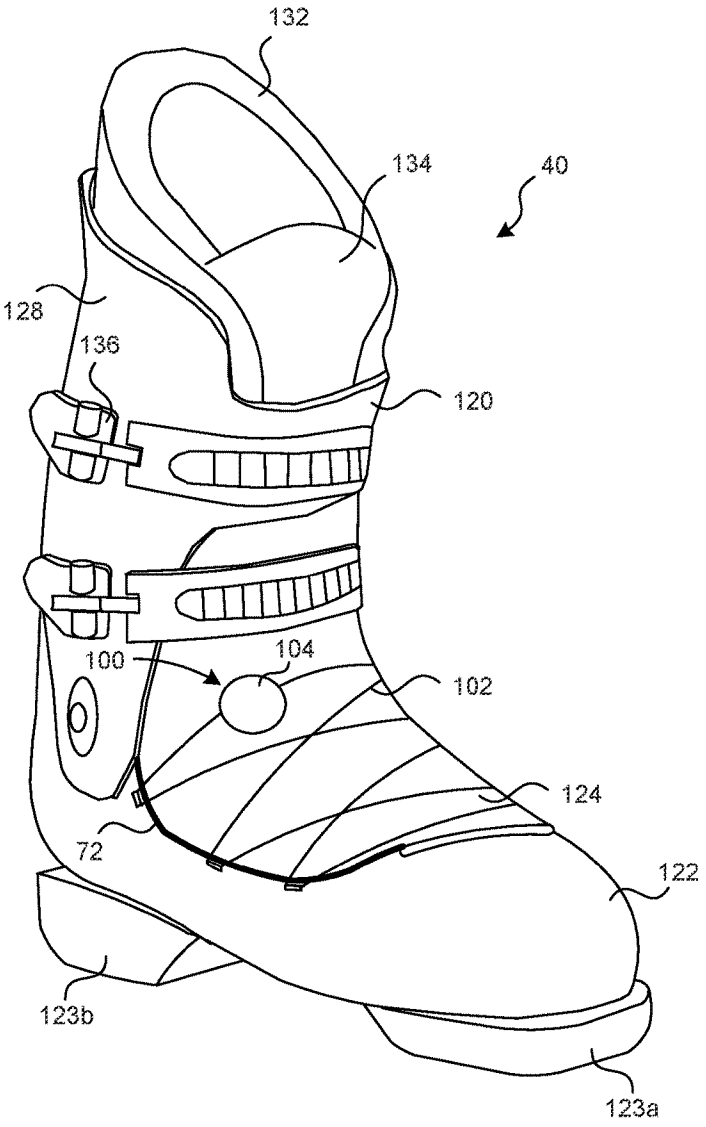
FIG. 11C is an isometric view of the ski boot of FIG. 11A with multiple closure systems.

The ski boot 120 can use a mix of closure devices 136, such as one or more buckles 137 in combination with a Boa closure 100. In the embodiment shown in FIG. 11C, the ski boot 120 has buckles on the boot cuff portion 128 and has a Boa closure 100 or other closure mechanism on the lower portion of the boot. The Boa closure 100 is anchored to the plantar shell 122 and extends across the dorsal shell 124 above the instep and forefoot portions of the wearer's foot. Other embodiments can use other closure devices 136 to securely retain the dorsal shell 124 in the closed position, so as to pre-compress the instep of the wearer's foot while also providing the precise, personalized fit to the wearer's foot as discussed above.

Figure 12:
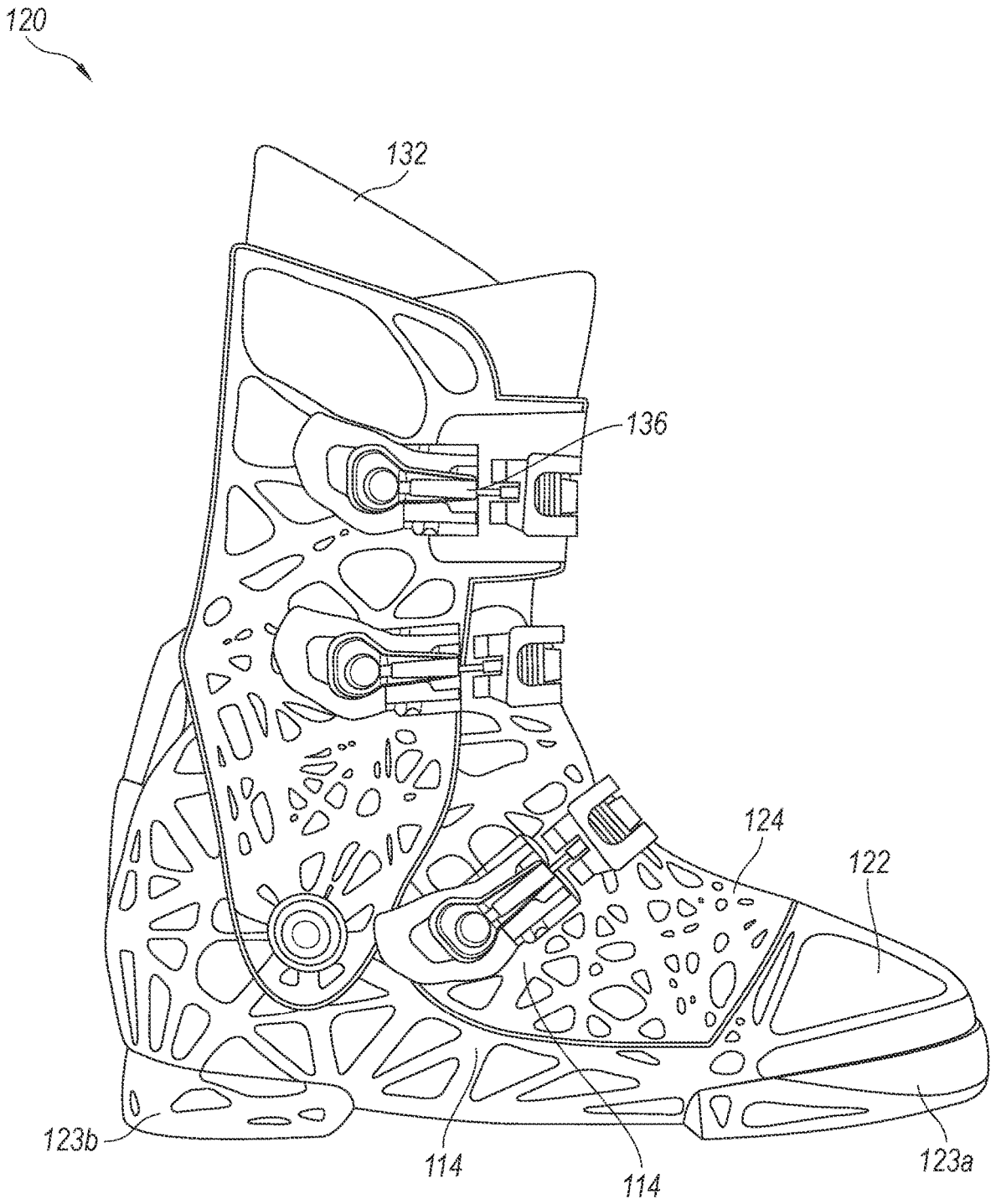
FIG. 12 is a side view of a ski boot made in accordance with an embodiment of the present technology.

FIG. 12 is a side view of a ski boot 120 in accordance with an embodiment of the present technology that has the similar ski boot construction as discussed above. In this embodiment, the plantar shell 122 and dorsal shell 124 are personalized shells specifically shaped, sized, and contoured based on 3-D scans of a wearer's foot. The plantar and dorsal shells 122 and 124 are manufactured using 3-D printing or other additive or non-additive manufacturing technology using a high-strength polymer, which may be a fiber-reinforced, high-strength polymer. The plantar and dorsal shells 122 and 124 each have a plurality of integral reinforcement ribs 114 positioned and oriented at selected areas to control the force distribution and load paths in the boot. Reinforcement ribs 114 of the plantar shell 122 in the illustrated embodiment can align with the reinforcement ribs 114 of the dorsal shell 124 when in the closed position, thereby providing precise load distribution between the plantar and dorsal shells 122 and 124, or the alignment of the reinforcement ribs 114 on the plantar and dorsal shells 122 and 124 can be independent. The reinforcement ribs 114 can be provided in areas of the boot at selected orientations, thicknesses, and lengths so as to selectively direct and control the forces through the boot during use. As a result, other areas of the plantar and/or dorsal shells 122 and 124 can have a reduced thickness and can be manufactured with less material. This construction provides for a personalized ski boot with a precision fit and that is stiff and strong, yet extremely lightweight, as well as providing the additional benefits of the footwear described herein.

Figure 13B:
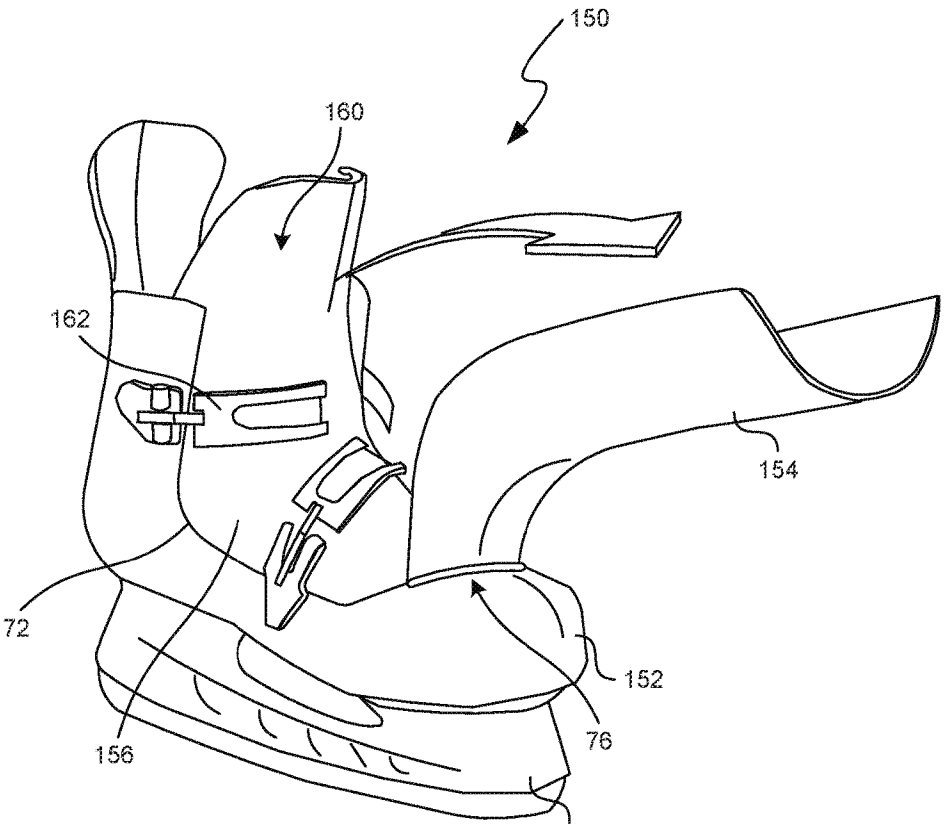
FIG. 13B is an isometric view of the hockey skate of FIG. 13A with the dorsal shell shown in the open position.
Figure 13A:
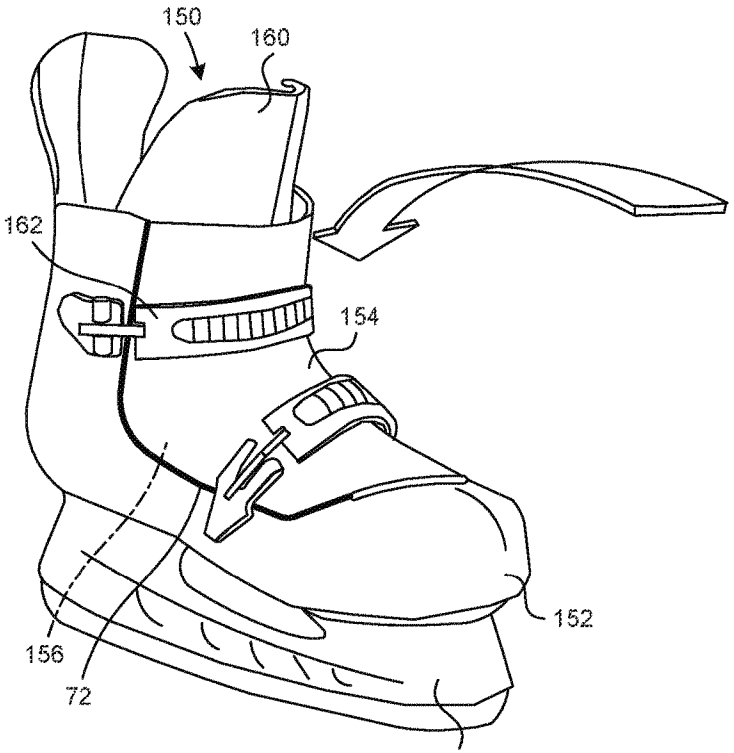
FIG. 13A is an isometric view of a hockey skate in accordance with an embodiment of present technology.

FIGS. 13A and 13B are isometric views of a hockey skate 150 in accordance with the present technology. The hockey skate 150 has a personalized, custom fit for a skater's foot with mating plantar and dorsal shells 152 and 154 constructed via 3-D printing or other additive or non-additive manufacturing based on a 3-D scan of the skater's foot. The plantar and dorsal shells 152 and 154 mate as described above when the dorsal shell 154 is in the closed position covering the opening 156 formed by the plantar shell 152 so as to pre-compress the instep of the skater's foot. In the illustrated embodiment, the skate 150 has a liner 160 shaped and sized to closely conform to the skater's foot. The liner 160 is removably received within the interior area of the plantar shell 152. When the dorsal shell 154 is in the closed position, as shown in FIG. 13A, the dorsal shell 154 engages the plantar shell 152 to form the caging system 45 surrounding the foot with the planar alignment at the interface between the plantar and dorsal shells 152 and 154. The liner 160 is constructed such that the dorsal shell 154 will provide the compression loading to the wearer's foot directly through the portion of liner 160 covering the instep. The dorsal shell 154 of the illustrated embodiment is pivotally or otherwise attached to the plantar shell to allow the dorsal shell 154 to move between the closed position (FIG. 13A) and the open position (FIG. 13B). When the dorsal shell 154 is in the open position, the skater can insert or remove his or her foot from the skate through the opening 156.

Figure 13C:
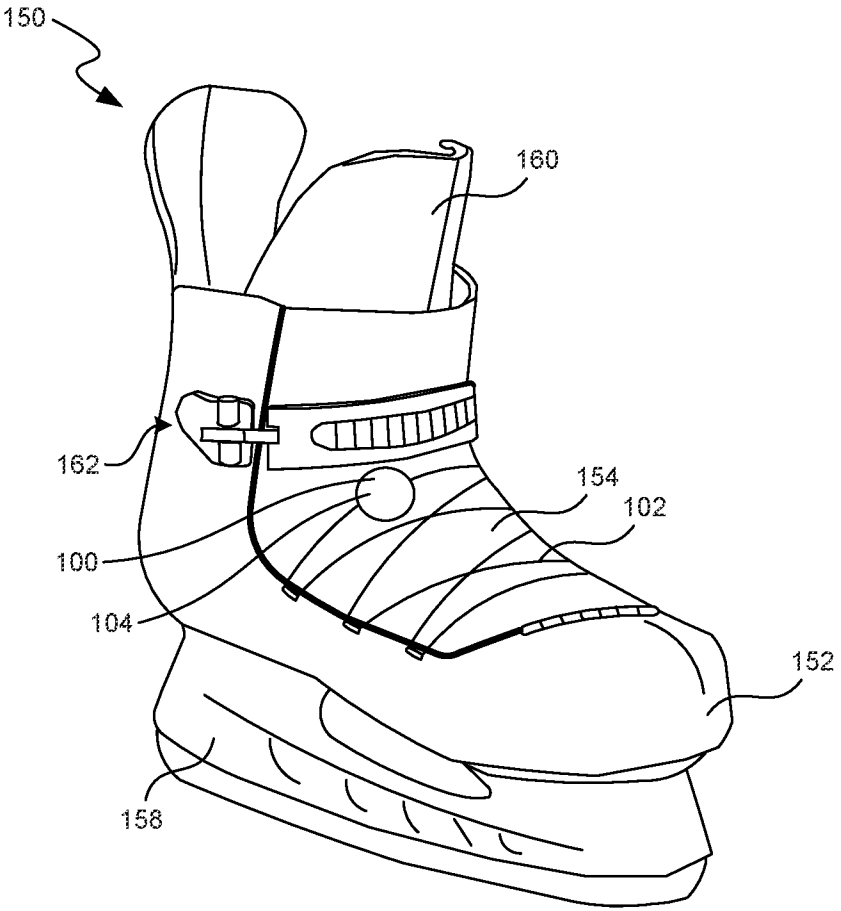
FIG. 13C is an isometric view of the hockey skate of FIG. 13A with multiple closure systems.

The skate 150 has one or more buckles 162 that releasably retain the dorsal shell 154 in the closed position. In the illustrated embodiment, the buckles 162 can be ladder catch-style buckles anchored to the plantar shell 152 and configured to extend across the dorsal shell 154 to releasably retain the dorsal shell 154 closed. Other embodiments can use other buckle styles, including strap and ratchet configurations. The skate 150 can have a plurality of the same style buckles 162 or other closure devices. In other embodiments, the skate 150 can have a plurality of closure devices of different types. As seen in FIG. 13C, the illustrated skate 150 has an upper buckle 162 attached to the plantar shell 152 above the ankle area and extending across the dorsal shell 154, forward of the skater's lower shin portion. The skate 150 can also have a lower Boa closure 100 or other closure mechanism anchored to the plantar shell 152 adjacent to the opening 156, such that the cabling 102 crisscrosses over the dorsal shell 154 and connects to the dial 104 for tightening and loosening adjustments.

The skate 150 of the illustrated embodiments is an ice skate with a blade assembly 158 affixed to the bottom portion of the plantar shell 152. In other embodiments, the skate 150 can be a wheeled skate, such as an in-line wheeled skate with the assembly of wheels coupled to the bottom portion of the plantar shell 152.

The footwear assembly of the present technology is discussed above in connection with performance activities, such as cycling, skiing, and skating, although the footwear in accordance with the present technology can be used in connection with other activities, including highly dynamic activities (e.g., hiking, climbing, motorcycle riding, or other sporting and non-sporting activities), while providing the benefits of the footwear described herein. The footwear assembly of the present technology can also be used in less dynamic or non-dynamic environments.

Figure 14B:
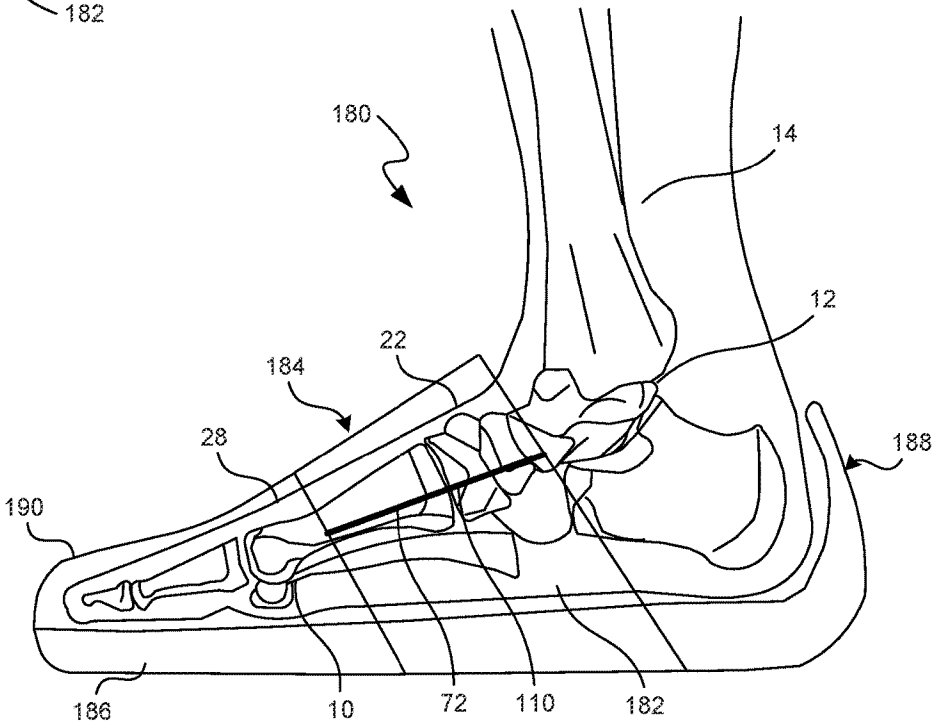
FIG. 14B is a side elevation view of the sandal of FIG. 14A.
Figure 14A:
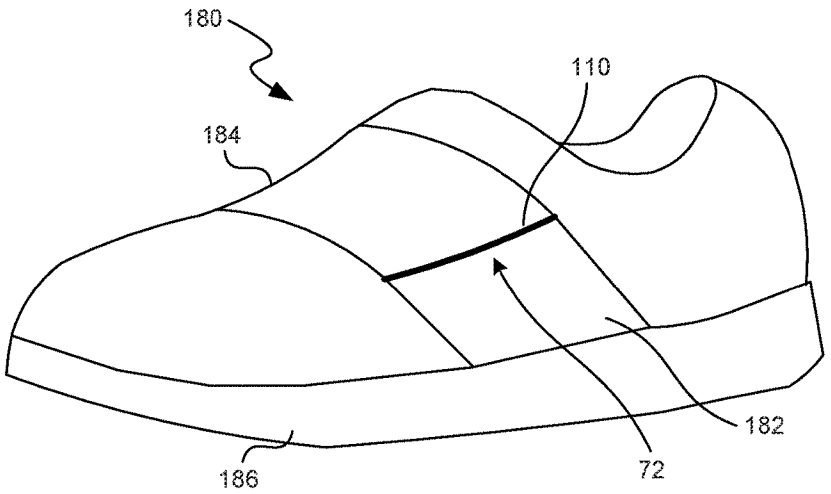
FIG. 14A is an isometric view of a sandal assembly in accordance with another embodiment of the present technology.

FIGS. 14A and 14B are isometric and side views of a sandal assembly 180 incorporating the plantar and dorsal shells 182 and 184 positioned generally in alignment with the instep portion 22 and forefoot portion 28 of the wearer's foot. In the illustrated embodiment shown in FIG. 14B, the sandal assembly 180 has a sole assembly 186 shaped and sized to define a footbed on which the wearer's foot 10 is supported. The sole assembly 186 can include a heel cup 188 at the rear of the footbed area, and/or a toe shield 190 at the front of the footbed area. The plantar shell 182 is integrally connected or otherwise anchored to the sole assembly 186 in the midfoot area and projects upwardly and forwardly to form the medial and lateral sidewalls that terminate at an upper edge portion with integral shell locking features similar to the locking features discussed above.

The dorsal shell 184 is shaped and sized based on the 3-D scan of the wearer's foot to extend over the foot's instep. The dorsal shell 184 has mating locking features configured to releasably engage the locking features of the plantar shell 182, so as to maintain the planar alignment at the joint between the plantar and dorsal shells 182 and 184. The dorsal shell 184 can be releasably attached to the plantar shell through a quick release closure system 110 as described above in connection with the triathlon shoe, while pre-compressing the wearer's instep 22 when wearing the sandal 180. Accordingly, the plantar and dorsal shells 182 and 184 do not extend the full length of the sandal but define an arcuate segment over the middle portion of the wearer's foot 10 forward of the ankle 12.

Figure 15B:
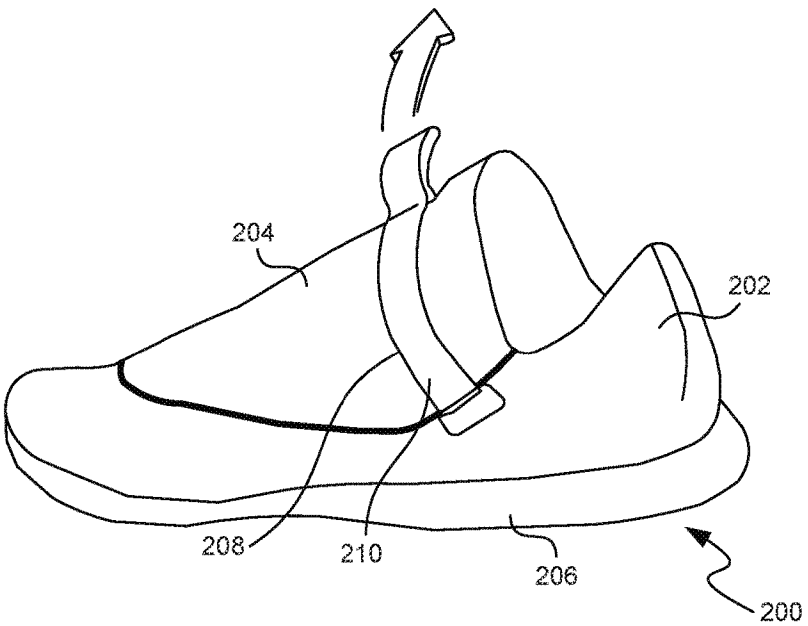
FIG. 15B is a rear isometric view of the shoe of FIG. 15A with a strap closure system.
Figure 15A:
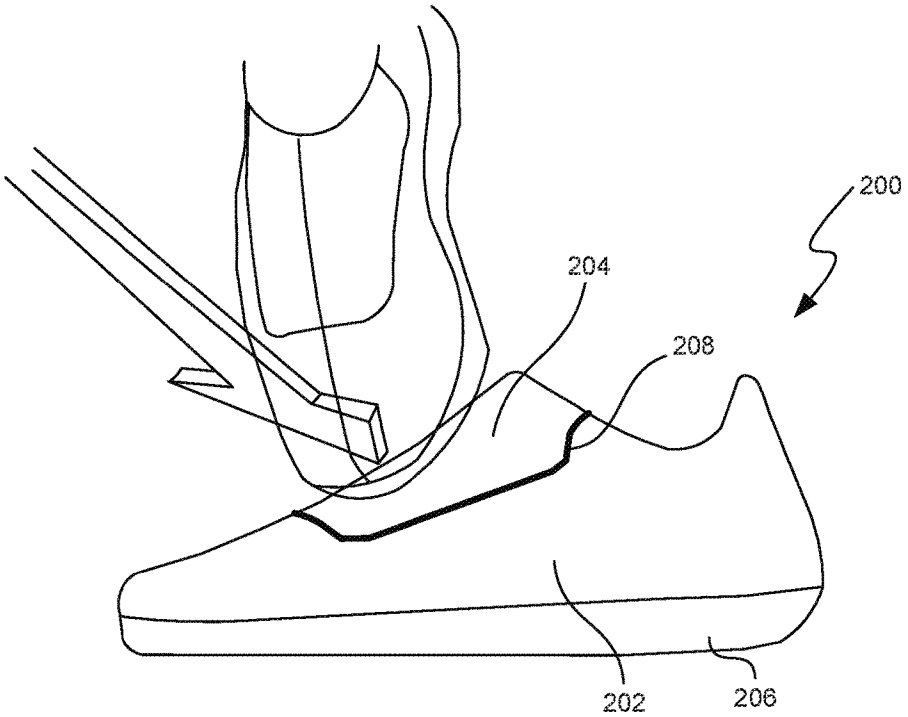
FIG. 15A is a side elevation view of a shoe in accordance with another embodiment of the present technology.

In another embodiment illustrated in FIGS. 15A-15D, a footwear assembly in accordance with the present technology can be provided in the form of a shoe 200, such as an everyday casual, lifestyle shoe. The shoe 200 has a plantar shell 202 integrally connected to or otherwise affixed to a sole assembly 206. A dorsal shell 204 is pivotally or otherwise connected to the plantar shell 202 to as discussed above to form the caging system 45. The plantar shell 202 and dorsal shell 204 are constructed via additive or non-additive manufacturing based on the 3-D scan of the wearer's foot. The dorsal shell 204 can be releasably retained in the closed position on the plantar shell with a quick closure system 100 as discussed above. In other embodiments, the shoe 200 can include a closure device 208 in the form of a releasable strap 210 anchored to the plantar shell 202 and extending across the dorsal shell 204 when in the closed position, as shown in FIG. 15B. The closure device 208 in other embodiments can be a buckle system, a Boa closure, and/or other closure mechanism.

Figure 15C:
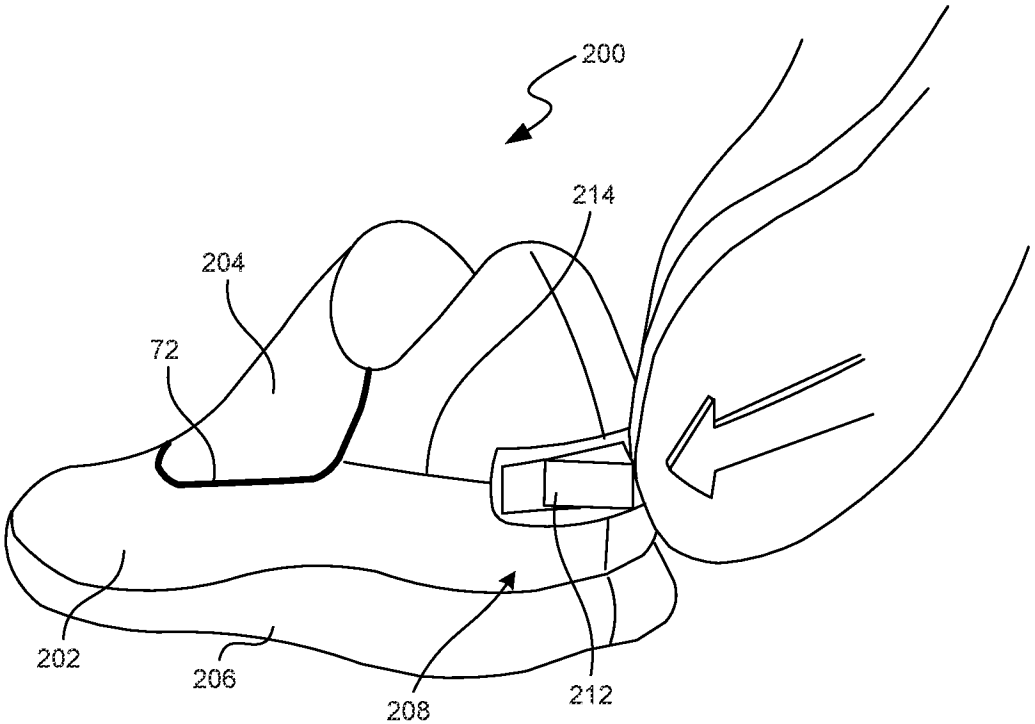
FIG. 15C is a rear isometric view of the shoe of FIG. 15A with a cable closure system.
Figure 15D:
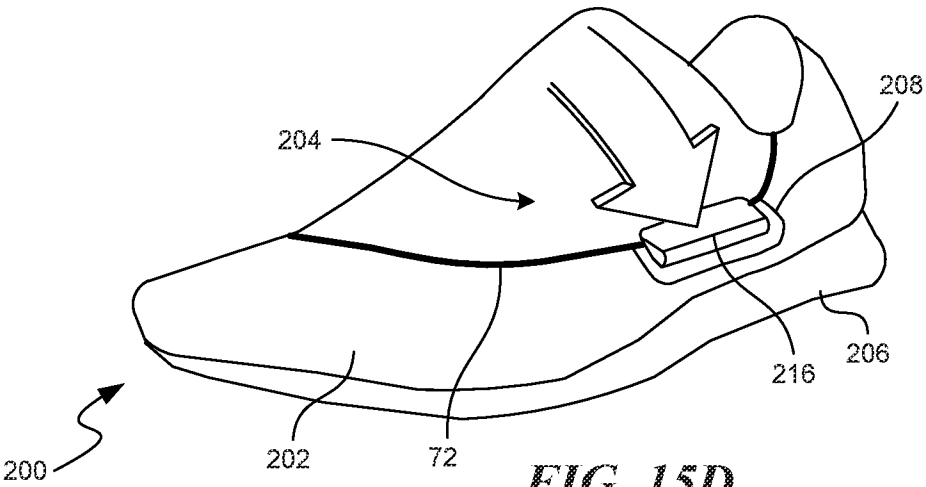
FIG. 15D is an isometric view of the shoe of FIG. 15A with another closure system.

As seen in FIG. 15C, the closure device 208 can be a latch mechanism 212 coupled to a cable 214 anchored to the dorsal shell and configured to pull and hold the dorsal shell 204 in the closed position to pre-compress the instep of the wearer's foot. Another closure system, as shown in FIG. 15D can be a releasable snap latch assembly 216 anchored to, for example, a medial or lateral sidewall of the plantar shell and configured to releasably engage a retention feature formed on the mating edge of the dorsal shell 204. In other embodiments, other closure devices can be used to securely retain the dorsal shell 204 in the closed position so as to pre-compress the wearer's instep and securely maintain the planar alignment between the dorsal and plantar shells 202 and 204 to form the caging system within which the wearer's foot is securely retained.

Figure 16B:
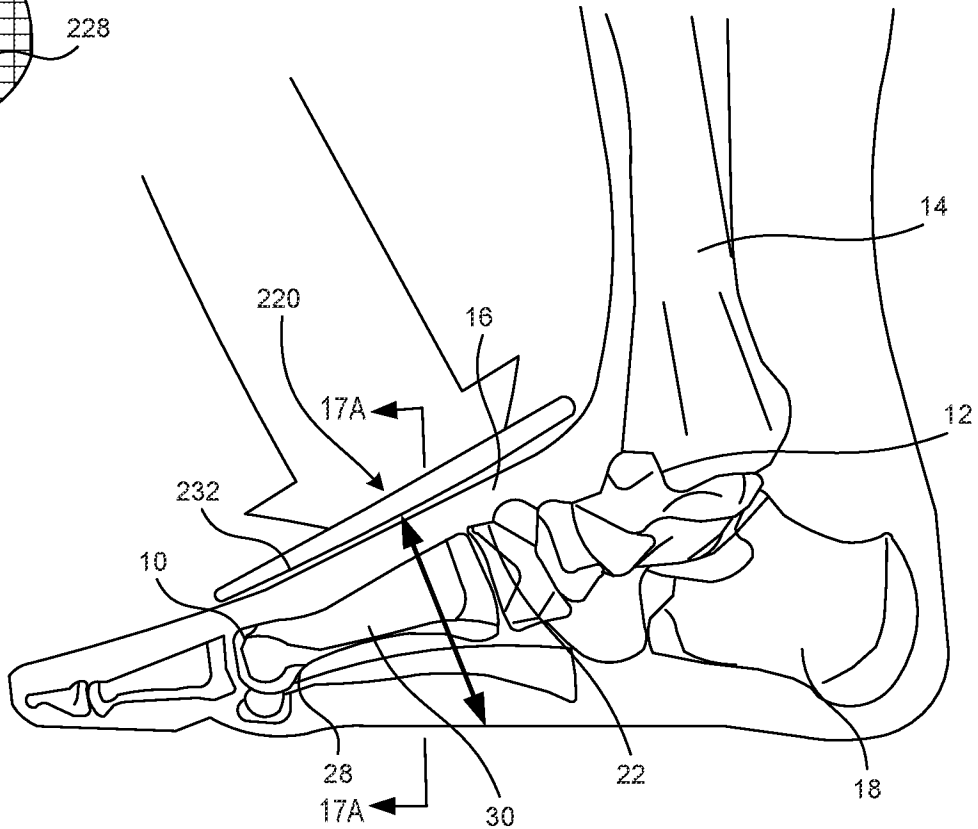
FIG. 16B is a cross-sectional view taken substantially along line 16B-16B of FIG. 16A.
Figure 16A:
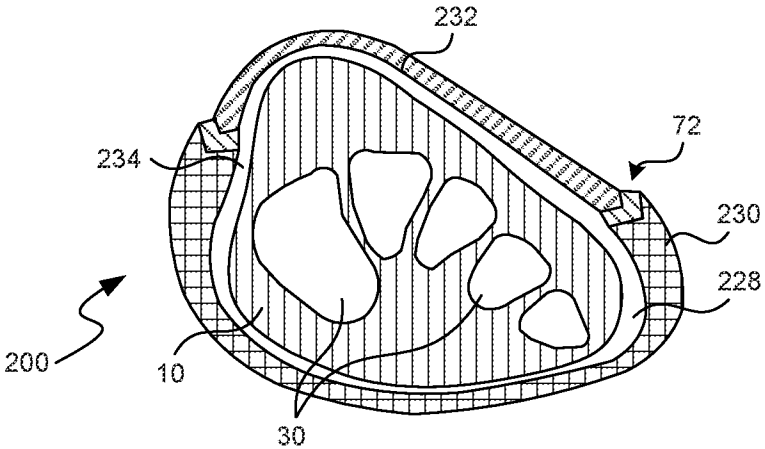
FIG. 16A is a side view of the footwear assembly with a dorsal orthotic configuration in accordance with another embodiment of the present technology.

FIG. 16A is a schematic cross-sectional view of a footwear assembly 220 in accordance with the present technology with a wearer's foot 10 and metatarsals 30 shown in the interior area 226 of the caging system 228 formed by the plantar and dorsal shells 230 and 232, as discussed above. One of the benefits of precisely building the plantar and dorsal shells 230 and 232 based on the 3-D scan of the wearer's foot is that the plantar and dorsal shells can be configured to align with specific areas of the wearer's foot 10 and to selectively apply pressures to those specific areas to achieve the selected precision fit as desired. For example, one or more 3-D scans of the wearer's foot 10 can be conducted in selected conditions, such as in a loaded or unloaded condition, in a bipedal stance, and/or in a monopedal stance. These 3-D scans can provide information about the wearer's foot alignment in a variety of conditions.

The plantar and dorsal shells 230 and 232 can then be specifically constructed to provide dorsal orthotic support to the foot 10 to address the wearer's specific foot alignment configuration and to apply selected pressures to the wearer's foot 10. These pressures can be selectively applied to control foot alignment, including while walking, running, or other dynamic motions. This alignment control can be used to support the foot 10 to counter pronation, supination, or other foot alignment issues. The plantar and dorsal shells 230 and 232 can be built to provide the dorsal orthotic support from the top portion of the foot 10 by controlling the size and location of the medial gap 234 in the caging system 228 relative to the foot 10, as well as controlling the thickness of foam/padding between the medial wall and the foot, the thickness of foam/padding between the lateral wall and the foot, and the location of the lateral wall in relation to the foot.

In one embodiment, the caging system 228 formed by the plantar and dorsal shells 230 and 232 is specifically configured to pre-compress the foot's instep 22, as discussed above, while also minimizing the size of the medial gap 234 to prevent over-pronation of the foot 10. Alternatively, the caging system 228 can be configured to provide a larger medial gap 234 in selected locations to avoid under pronation or supination of the foot. For example, the lateral wall of the caging system and/or the dorsal shell 232 is configured to control supination, resist lateral rotation or movement of the foot, to further transfer energy to the caging system and therefore to the associated piece of sporting equipment or external environment. The precise and rigid restraint and configurations of the lateral and medial sidewalls in relation to the foot creates both better neutral alignment and support of the foot as well as more powerful and efficient biomechanical power transfer between foot and caging system during dynamic athletic activity. A degree of supination followed by pronation (rotational force) is generated during the natural transition between bi-pedal to monopedal stance in athletic movement. By precisely containing and positioning the dorsal aspect of the foot via the shell structure of the caging system, rotational forces are efficiently captured via the footwear structure during both the supination and pronation phases of monopedal loading. The caging system 228 is also configured to provide the dorsal orthotic support to selectively control and maintain a desired alignment of the metatarsal bones 30 and/or other bones in the foot during highly dynamic activities in which the foot 10, ankle 12, and/or lower leg 14 (FIG. 16B) may be subject to large and repetitive linear and/or torsional loads. Further, the dorsal shell 232 can be configured to press against and pre-compress the wearer's instep 22 with a selected pressure distribution so as to control engagement of the bottom of the foot within the caging system 228. In some embodiments, additional padding can be provided within the caging system 228 with selected compression characteristics or thicknesses so as to facilitate the orthotic function and motion control of the foot within the caging system 228.

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

As used herein, the word "or" refers to any possible permutation of a set of items. For example, the phrase "A, B, or C" refers to at least one of A, B, and C, or any combination therefore, such as any of A; B; C; A and B; A and C; B and C; A, B, and C; or multiple of any item such as A and A; B, B, and C; A, A, B, C, and C; etc.

Although the subject matter has been described in language specific to structural features and/or methodological acts, it is to be understood that the subject matter defined in the appended claims is not necessarily limited to the specific features or acts described above. Specific embodiments and implementations have been described herein for purposes of illustration, but various modifications can be made without deviating from the scope of the embodiments and implementations. The specific features and acts described above are disclosed as example forms of implementing the claims that follow. Accordingly, the embodiments and implementations are not limited except as by the appended claims.

We claim:

1. A footwear assembly, comprising:

a plantar shell that at least partially defines an interior area of the footwear assembly, wherein the interior area is sized to receive a wearer's foot, and wherein the plantar shell includes— a plantar shell contour shaped to conform with a bottom surface contour of the wearer's foot, an upper perimeter portion forming an opening to the interior area configured to receive at least a portion of the wearer's foot therethrough, and a plurality of plantar shell ribs, wherein at least a first subset of the plurality of plantar shell ribs extend longitudinally along an underside of the plantar shell between heel and forefoot portions, wherein at least a second subset of the plurality of plantar shell ribs extend laterally between medial and lateral sides of the plantar shell and intersect with one or more of the first subset of the plurality of plantar shell ribs to distribute loads in the plantar shell around the wearer's foot during use when positioned in the interior area;

each of the plurality of plantar shell ribs include a reinforcement fiber material and a matrix material that structurally affixes the reinforcement fiber material to the plantar shell seed layer so that the reinforcement fiber material maintains the stiffness of the plantar shell, wherein the reinforcement fiber material includes carbon fiber and wherein the matrix material includes epoxy;

wherein individual ones of the plantar shell ribs define an alignment channel, and wherein the reinforcement fiber material and the matrix material are positioned within the alignment channel; and a dorsal shell movable between (i) an open position in which the dorsal shell is positioned relative to the plantar shell to allow the wearer's foot to be inserted or removed from the interior area, and (ii) a closed position in which the dorsal shell is coupled to the plantar shell to at least partially enclose the wearer's foot in the interior area, the dorsal shell including— a dorsal shell contour shaped to conform with an upper surface contour of the wearer's foot, an outer perimeter portion configured to abut the upper perimeter portion of the plantar shell to form a caging system that transfers loads between the dorsal and plantar shells when the dorsal shell is in the closed position and during use of the footwear by the wearer, and a plurality of dorsal shell ribs;

wherein, in the closed position, individual ones of the plantar shell ribs align with a corresponding one of the dorsal shell ribs along a joint between the upper perimeter portion and the outer perimeter portion in a configuration that provides load distribution between the plantar and dorsal shells; and wherein a vertical position of the dorsal shell relative to the plantar shell is adjustable to provide compressive force to an instep portion of the wearer's foot when the dorsal shell is in the closed position.

2. The footwear assembly of claim 1 wherein the plantar shell or the dorsal shell comprise an alignment feature configured to engage the other of the dorsal shell or the plantar shell and to control relative movement between the plantar shell and the dorsal shell when the dorsal shell is in the closed position.

3. The footwear assembly of claim 1 wherein the plantar shell includes a first locking feature, wherein the dorsal shell includes a second locking feature configured to detachably engage with the first locking feature, and wherein, in the closed position, the first locking feature engages the second locking feature to couple the plantar shell to the dorsal shell.

4. The footwear assembly of claim 1 wherein the plurality of plantar shell ribs are positioned and oriented at selected areas to control the force distribution and load paths in the plantar shell during use, wherein the plantar shell has openings free of material between the plurality of plantar shell ribs.

5. The footwear assembly of claim 1, further comprising an inner liner within the plantar shell within the interior area of the plantar shell, wherein the liner is configured to removably receive the wearer's foot.

6. The footwear assembly of claim 1, further comprising a hinge member that pivotally coupled the dorsal shell to the plantar shell such that the dorsal shell is rotatable about the hinge member to transition the dorsal shell between the open position and the closed position.

7. The footwear assembly of claim 1 further comprising a closure device operably coupled to the plantar shell and the dorsal shell, wherein the closure device is movable between (i) an unlocked position in which the dorsal shell is movable between the open and closed positions, and (ii) a locked position in which the closure device secures the dorsal shell to the plantar shell in the closed position.

8. The footwear assembly of claim 1 wherein the forefoot portion of the plantar shell is shaped to conform to a corresponding forefoot portion of the wearer's foot and the heel portion of the plantar shell is shaped to conform to a corresponding heel portion of the wearer's foot, and wherein the plantar shell further includes (i) a medial sidewall shell portion extending at least partially between the forefoot portion of the plantar shell and the heel portion of the plantar shell on a medial side of the caging system, and (ii) and a lateral sidewall shell portion extending at least partially between the forefoot portion of the plantar shell and the heel portion of the plantar shell on a lateral side of the caging system opposite the medial side, wherein, in the closed position, the medial sidewall shell portion and the lateral sidewall shell portion contact respective medial and lateral sides of the wearer's foot to reduce movement of the wearer's foot in respective medial and lateral directions.

9. The footwear assembly of claim 1 wherein the dorsal shell further includes one or more independent shell ribs positioned out of alignment with the plantar shell ribs when the dorsal shell is in the closed position.

10. The footwear assembly of claim 1 wherein, in the closed position, the dorsal shell is configured to (i) contact a first portion of the wearer's foot and apply a first force to the first portion of the wearer's foot, and (ii) contact a second portion of the wearer's foot and apply a second force to the second portion of the wearer's foot, wherein the first force is different than the second force.

11. A footwear assembly, comprising:

a plantar shell that at least partially defines an interior area of the footwear assembly, wherein the interior area is sized to receive a wearer's foot, and wherein the plantar shell includes— a plantar shell seed layer having (i) a plantar shell contour shaped to conform with a bottom surface contour of the wearer's foot and (ii) an upper perimeter portion forming an opening to the interior area configured to receive at least a portion of the wearer's foot therethrough, and a plurality of plantar shell ribs coupled to the plantar shell seed layer, wherein— at least a first subset of the plurality of plantar shell ribs extend longitudinally along an underside of the plantar shell between heel and forefoot portions, at least a second subset of the plurality of plantar shell ribs extend laterally between medial and lateral sides of the plantar shell and intersect with one or more of the first subset of the plurality of plantar shell ribs to distribute loads in the plantar shell around the wearer's foot during use, and each of the plurality of plantar shell ribs include a reinforcement fiber material and a matrix material that structurally affixes the reinforcement fiber material to the plantar shell seed layer so that the reinforcement fiber material maintains the stiffness of the plantar shell;

wherein individual ones of the plantar shell ribs define an alignment channel, and wherein the reinforcement fiber material and the matrix material are positioned within the alignment channel; and a dorsal shell including a dorsal shell contour shaped to conform with an upper surface contour of the wearer's foot, wherein— the dorsal shell is movable between (i) an open position in which the dorsal shell is positioned relative to the plantar shell to allow the wearer's foot to be inserted or removed from the interior area, and (ii) a closed position in which the dorsal shell is coupled to the plantar shell to at least partially enclose the wearer's foot in the interior area, the dorsal shell has an outer perimeter portion configured to abut the upper perimeter portion of the plantar shell to form a caging system that transfers loads between the dorsal and plantar shells when the dorsal shell is in the closed position and during use of the footwear by the wearer, and a vertical position of the dorsal shell relative to the plantar shell is adjustable to provide compressive force to an instep portion of the wearer's foot when the dorsal shell is in the closed position.

12. The footwear assembly of claim 11 wherein the plantar shell seed layer has an exterior surface, and wherein the reinforcement fiber material is coupled to the exterior surface.

13. The footwear assembly of claim 11 wherein the plantar shell seed layer has an exterior surface, and wherein the plantar shell ribs are coupled to and extend outwardly from the exterior surface.

14. The footwear assembly of claim 11 wherein the reinforcement fiber material is continuous across the plantar shell.

15. The footwear assembly of claim 11 wherein the reinforcement fiber material is a first reinforcement fiber material and the matrix material is a first matrix material, wherein the dorsal shell further includes a dorsal shell seed layer and one or more dorsal shell ribs coupled to the dorsal shell seed layer, and wherein the one or more dorsal shell ribs each include— a second reinforcement fiber material, and a second matrix material that structurally affixes the second reinforcement fiber material to the dorsal shell seed layer so that the second reinforcement fiber material maintains the stiffness of the dorsal shell.

16. A footwear assembly, comprising:

a plantar shell that at least partially defines an interior area of the footwear assembly, wherein the interior area is sized to receive a wearer's foot, and wherein the plantar shell includes— a plantar shell seed layer having (i) a plantar shell contour shaped to conform with a bottom surface contour of the wearer's foot and (ii) an upper perimeter portion forming an opening to the interior area configured to receive at least a portion of the wearer's foot therethrough, and a plurality of plantar shell ribs coupled to the plantar shell seed layer, wherein— at least a first subset of the plurality of plantar shell ribs extend longitudinally along an underside of the plantar shell between heel and forefoot portions, at least a second subset of the plurality of plantar shell ribs extend laterally between medial and lateral sides of the plantar shell and intersect with one or more of the first subset of the plurality of plantar shell ribs to distribute loads in the plantar shell around the wearer's foot during use, and each of the plurality of plantar shell ribs include a reinforcement fiber material and a matrix material that structurally affixes the reinforcement fiber material to the plantar shell seed layer so that the reinforcement fiber material maintains the stiffness of the plantar shell; wherein the reinforcement fiber material includes carbon fiber and wherein the matrix material includes epoxy; and a dorsal shell including a dorsal shell contour shaped to conform with an upper surface contour of the wearer's foot, wherein— the dorsal shell is movable between (i) an open position which the dorsal shell is positioned relative to the plantar shell to allow the wearer's foot to be inserted or removed from the interior area, and (ii) a closed position in which the dorsal shell is coupled to the plantar shell to at least partially enclose the wearer's foot in the interior area, the dorsal shell has an outer perimeter portion configured to abut the upper perimeter portion of the plantar shell to form a caging system that transfers loads between the dorsal and plantar shells when the dorsal shell is in the closed position and during use of the footwear by the wearer, and a vertical position of the dorsal shell relative to the plantar shell is adjustable to provide compressive force to an instep portion of the wearer's foot when the dorsal shell is in the closed position.

17. A footwear assembly, comprising:

a plantar shell that at least partially defines an interior area of the footwear assembly that is sized to receive a wearer's foot, wherein— the plantar shell includes a plurality of plantar shell ribs, at least a first subset of the plurality of plantar shell ribs extend longitudinally along an underside of the plantar shell between heel and forefoot portions, and at least a second subset of the plurality of plantar ribs extend laterally between medial and lateral sides of the plantar shell and intersect with one or more of the first subset of the plurality of plantar shell ribs to distribute loads in the plantar shell around the wearer's foot during use;

each of the plurality of plantar shell ribs include a reinforcement fiber material and a matrix material that structurally affixes the reinforcement fiber material to the plantar shell seed layer so that the reinforcement fiber material maintains the stiffness of the plantar shell, wherein the reinforcement fiber material includes carbon fiber and wherein the matrix material includes epoxy;

wherein individual ones of the plantar shell ribs define an alignment channel, and wherein the reinforcement fiber material and the matrix material are positioned within the alignment channel; and a dorsal shell configured to be removably seated against the plantar shell to at least partially enclose the wearer's foot in the interior area to define a caging system that transfers loads between the dorsal and plantar shells during use of the footwear by the wearer, wherein the dorsal shell includes a plurality of dorsal shell ribs, and wherein at least a subset of the plurality of dorsal shell ribs extend longitudinally along an instep portion of the dorsal shell.

18. The footwear assembly of claim 17, further comprising a closure device operably coupled to the plantar shell and the dorsal shell, wherein the closure device is movable between (i) an unlocked position in which the dorsal shell is movable between open and closed positions, and (ii) a locked position in which the closure device secures the dorsal shell to the plantar shell in the closed position.

19. The footwear assembly of claim 18, wherein the closure device includes an adjustment dial and a cable, wherein the adjustment dial is coupled to the dorsal shell and the cable extends over the dorsal shell and at least some of the dorsal shell ribs.

* * * * *